US007895671B2

(12) United States Patent
Salomon

(10) Patent No.: US 7,895,671 B2
(45) Date of Patent: Mar. 1, 2011

(54) FINGER PROTECTING DEVICE AND METHOD FOR PROTECTING AT LEAST ONE FINGER

(75) Inventor: Justin A. Salomon, Montreal (CA)

(73) Assignee: Game Theory Inc., Montreal, Quebec (CA)

( * ) Notice: Subject to any disclaimer, the term of this patent is extended or adjusted under 35 U.S.C. 154(b) by 391 days.

(21) Appl. No.: 10/545,029

(22) PCT Filed: Feb. 11, 2004

(86) PCT No.: PCT/CA2004/000185

§ 371 (c)(1),
(2), (4) Date: May 16, 2006

(87) PCT Pub. No.: WO2004/071599

PCT Pub. Date: Aug. 26, 2004

(65) Prior Publication Data

US 2006/0230487 A1 Oct. 19, 2006

Related U.S. Application Data

(60) Provisional application No. 60/468,658, filed on May 8, 2003, provisional application No. 60/491,515, filed on Aug. 1, 2003.

(30) Foreign Application Priority Data

Feb. 11, 2003 (CA) ..... 2418711

(51) Int. Cl.
*A63B 71/14* (2006.01)

(52) U.S. Cl. ..... 2/161.2; 2/161.4; 2/162; 2/163

(58) Field of Classification Search ..... 2/16, 20, 2/21, 159, 161.1, 161.2, 161.3, 161.5, 161.6, 2/161.7, 161.8, 162, 163
See application file for complete search history.

(56) References Cited

U.S. PATENT DOCUMENTS 632,547 A * 9/1899 Barth ..... 2/158

(Continued)

FOREIGN PATENT DOCUMENTS

CA 2306493 11/2001

(Continued)

OTHER PUBLICATIONS

Machine Translation of JP-2000-254268.

*Primary Examiner* — Gary L Welch
*Assistant Examiner* — Sally C Cline
(74) *Attorney, Agent, or Firm* — Ipaxio S.E.N.C.

(57) ABSTRACT

A finger protecting device for protecting at least one finger against chafing resulting from rubbing against the shaft when practicing a sport with the shaft, such as golfing. The device comprises a sleeve for the thumb. The sleeve has front and rear surfaces, the front surface being positioned before a digital area of the thumb for acting as a barrier between the thumb and the shaft. The sleeve has first and second opposite ends, the second end being open-ended for allowing the thumb to be inserted into the sleeve. The device comprises fastening means connected to the sleeve for selectively adjusting and fastening the sleeve onto the thumb. The device may comprise extension portions, as well as additional sleeves for other fingers of the hand, the other sleeves exposing the fingertips of the fingers to enable a better feel for the shaft.

11 Claims, 22 Drawing Sheets

U.S. PATENT DOCUMENTS

| | | | | | |
|---|---|---|---|---|---|
| 1,149,139 | A | * | 8/1915 | Heagle | 2/159 |
| 1,479,771 | A | | 1/1924 | Campbell | |
| 1,483,595 | A | | 2/1924 | Read | |
| 1,922,095 | A | * | 8/1933 | Jones | 2/159 |
| 2,025,710 | A | * | 12/1935 | Beemer | D2/617 |
| 2,187,987 | A | | 1/1940 | Sherrick | |
| 2,270,882 | A | | 1/1942 | Link | |
| 2,317,227 | A | | 4/1943 | Sherwood | |
| 2,447,328 | A | * | 8/1948 | Gerrits | 473/205 |
| 2,461,970 | A | | 2/1949 | Finegan | |
| 2,700,159 | A | * | 1/1955 | Denburgh | 2/20 |
| 2,769,179 | A | * | 11/1956 | Love | 2/161.5 |
| 2,827,635 | A | * | 3/1958 | Rasmus | 2/21 |
| 2,925,605 | A | | 2/1960 | Wheeler | |
| 2,949,610 | A | * | 8/1960 | Lutsky | 2/16 |
| 2,975,429 | A | * | 3/1961 | Newman | 2/161.2 |
| 3,387,306 | A | * | 6/1968 | Korey | 2/159 |
| 3,394,408 | A | * | 7/1968 | Bush | 2/159 |
| D243,292 | S | * | 2/1977 | Koehler | D29/113 |
| 4,025,962 | A | | 5/1977 | Hartung | |
| 4,064,563 | A | | 12/1977 | Stokes | |
| 4,164,043 | A | * | 8/1979 | Fujita | 2/161.1 |
| D267,129 | S | * | 12/1982 | Kneisley | D29/113 |
| 4,519,097 | A | * | 5/1985 | Chappell et al. | 2/16 |
| 4,573,220 | A | * | 3/1986 | Baker | 2/161.1 |
| 4,575,075 | A | | 3/1986 | Tarbox et al. | |
| 4,638,511 | A | | 1/1987 | Haack | |
| 4,658,441 | A | * | 4/1987 | Smith | 2/16 |
| 4,689,828 | A | * | 9/1987 | Brewer | 2/21 |
| 4,751,747 | A | * | 6/1988 | Banks et al. | 2/21 |
| 4,813,079 | A | | 3/1989 | Reitzel | |
| 4,882,787 | A | * | 11/1989 | Hull et al. | 2/161.5 |
| 4,894,866 | A | * | 1/1990 | Walker | 2/161.6 |
| 4,958,384 | A | * | 9/1990 | McCrane | 2/161.6 |
| D352,134 | S | * | 11/1994 | Crowder | D29/113 |
| 5,423,089 | A | | 6/1995 | Chun et al. | |
| 5,497,510 | A | | 3/1996 | Knowles et al. | |
| 5,517,692 | A | * | 5/1996 | Wunderlich-Kehm | 2/21 |
| 5,581,809 | A | * | 12/1996 | Mah | 2/20 |
| D378,148 | S | * | 2/1997 | Haney | D29/114 |
| 5,628,068 | A | | 5/1997 | DeLong | |
| 5,761,745 | A | | 6/1998 | Sato | |
| D400,308 | S | * | 10/1998 | Paparella et al. | D29/114 |
| 5,873,788 | A | | 2/1999 | Hoffman | |
| D412,048 | S | * | 7/1999 | Schiazza | D2/610 |
| 5,933,863 | A | * | 8/1999 | Monsue | 2/21 |
| 5,954,245 | A | | 9/1999 | Kluesner | |
| 6,009,557 | A | * | 1/2000 | Witta | 2/159 |
| 6,012,165 | A | | 1/2000 | Cain | |
| 6,035,443 | A | * | 3/2000 | Green | 2/161.2 |
| 6,101,628 | A | * | 8/2000 | Earl | 2/21 |
| 6,209,137 | B1 | * | 4/2001 | Wallick | 2/161.1 |
| 6,216,276 | B1 | * | 4/2001 | Eibert | 2/161.2 |
| 6,363,616 | B1 | | 4/2002 | Kreissle | |
| 6,409,059 | B1 | * | 6/2002 | Calvert | 223/101 |
| D472,035 | S | * | 3/2003 | McManis | D2/617 |
| D516,753 | S | * | 3/2006 | Grissom | D29/113 |
| D524,489 | S | * | 7/2006 | Scott | D29/113 |
| 7,114,193 | B2 | * | 10/2006 | Winningham | 2/163 |
| D533,314 | S | * | 12/2006 | Schiazza | D29/113 |
| D581,100 | S | * | 11/2008 | Stalter | D29/113 |
| D583,104 | S | * | 12/2008 | Stewart | D29/114 |
| 2002/0129436 | A1 | * | 9/2002 | Terris et al. | 2/161.2 |
| 2004/0060096 | A1 | * | 4/2004 | Thiruppathi | 2/161.1 |
| 2004/0177430 | A1 | * | 9/2004 | Gordon | 2/161.2 |
| 2009/0025120 | A1 | * | 1/2009 | Vestling | 2/161.1 |
| 2009/0158486 | A1 | * | 6/2009 | Cote | 2/21 |

FOREIGN PATENT DOCUMENTS

| | | | |
|---|---|---|---|
| DE | 19854237 | A1 | 2/2000 |
| DE | 20120306 | U1 | 8/2002 |
| GB | 2370215 | A | 6/2002 |
| JP | 57-157386 | U | 3/1981 |
| JP | 61-135169 | U | 9/1985 |
| JP | 61-205580 | U | 12/1986 |
| JP | 6-39073 | | 2/1994 |
| JP | 07-194755 | | 8/1995 |
| JP | 09-234265 | | 9/1997 |
| JP | 2000-254268 | | 9/2000 |
| JP | 2000-254268 | A | 9/2000 |

* cited by examiner

FINGER PROTECTING DEVICE AND METHOD FOR PROTECTING AT LEAST ONE FINGER

CROSS REFERENCE TO RELATED APPLICATIONS

This application claims priority to Patent Cooperation Treaty (PCT) Application No. PCT/CA2004/00185 filed on Feb. 11, 2004 entitled, FINGER PROTECTING DEVICE AND METHOD OF PROTECTING AT LEAST ONE FINGER, which claims priority to Canadian Patent Application Serial No. 2,418,711, filed Feb. 11, 2003; and U.S. Provisional Application Ser. Nos. 60/468,658 filed May 8, 2003; and 60/491,515 filed Aug. 1, 2003; all of the above disclosures are herein incorporated by reference in their entirety.

FIELD OF THE INVENTION

The present invention relates to a finger protecting device. More particularly, the present invention relates to a finger protecting device for protecting a finger, such as a thumb, index, middle finger or other for example, of a hand of a user of the device, against the occurrence of chafing resulting from rubbing of the finger against a shaft when practicing a sport with the shaft, examples of such sporting activities include golfing and the like, wherein the golf club is considered as being the shaft. The present invention also relates to a method for protecting at least one finger with the above-mentioned device.

BACKGROUND OF THE INVENTION

The game of golf, and the various stances and hand grips used when golfing are very well known in the art. Indeed, it is well known that most golfers, when gripping a golf club, wear a glove on their bottom hand, also known as the "glove hand", for obtaining a better grip of the golf club and to combat rubbing and blistering of the hand against the club. However, the thumb of the top hand, or "leading hand", which is typically not protected by a glove, is also in contact with the club, and thus, prone to rubbing against the club. It has been found that most golfers don't want or require the coverage provided by an entire glove on their top hand because the grip it provides is not needed and the use of an entire glove results in a substantially decreased "feel" for the club (and thus subsequently substantially decreased "feel" for the ball). Consequently, because the thumb of the non-gloved hand (i.e. leading hand) is left unprotected, it is prone to chafing and blistering resulting from its interaction (rubbing, etc.) with the club.

It is also known in the art that for every action, there is an equal and opposite reaction. Thus, when a golfer's thumb of a non-gloved hand pushes down onto a club, the index and/or middle finger (or other fingers for that matter) of the same hand push up which makes these other fingers just as prone to rubbing, blistering, chafing, and the like, as the thumb itself.

It is also known in the art that most golfers often resort to adhesive bandages to protect their fingers' skin. However, it has been found that these temporary remedies often need replacing after just a few swings as they very often tear, shift, or fall off with wear.

U.S. Pat. No. 6,035,443 granted to GREEN on Mar. 14, 2000, relates to an exposed palm golf glove for covering selected fingers of a golfer. There is described a palmless golf glove which allows for a normal grip stance of the golf club, chaffing protection for at least the second and third fingers, prevention of slippage and full palm tactility. The palmless golf glove includes a body section for covering a selected portion of the back (anterior) of a hand but not any of the palm of the hand, at least second and third finger receptacles connected to a forward end of the body section, and a wrist band for anchoring the palmless golf glove to the hand without slippage. In the preferred embodiment, the palmless golf glove includes closed-ended finger receptacles for selected fingers and a body section that completely exposes the palm.

Also known to the Applicant are the following patents and patent applications which describe different devices to be used with hands: U.S. Pat. No. 1,479,771; U.S. Pat. No. 1,483,595; U.S. Pat. No. 2,317,227; U.S. Pat. No. 2,700,159; U.S. Pat. No. 2,769,179; U.S. Pat. No. 2,949,610; U.S. Pat. No. 2,975,429; U.S. Pat. No. 4,025,962; U.S. Pat. No. 4,064,563; U.S. Pat. No. 4,164,043; U.S. Pat. No. 4,573,220; U.S. Pat. No. 4,575,075; U.S. Pat. No. 4,638,511; U.S. Pat. No. 4,813,079; U.S. Pat. No. 4,882,787; U.S. Pat. No. 5,423,089; U.S. Pat. No. 5,497,510; U.S. Pat. No. 5,628,068; U.S. Pat. No. 5,873,788; U.S. Pat. No. 6,035,443; CA 2,306,493; DE 198 54 237 A1; JP 6039073; and JP 2000254268.

A significant problem associated with the devices described in the above-mentioned prior art documents is that they do not teach to have a finger protecting device intended for protecting at least one finger of a hand of a user of the device against the occurrence of chafing resulting from rubbing of the at least one finger against the shaft when practicing a sport with the shaft, while at the same time enabling other fingers of the hand to have their fingertips exposed so as to have a proper "feel" of the shaft when holding the shaft.

Another significant problem associated with the devices described in the above-mentioned prior art documents is that they do not teach a finger protecting device for protecting at least one finger of a hand of a user of the device against the occurrence of chafing resulting from rubbing of the at least one finger against the shaft when practicing a sport with the shaft, the finger device comprising fastening means which are more easily operable with a gloved hand for example, and which are also devised to maintain the finger protecting device in a given configuration.

Hence, in light of the aforementioned, there is a need for an improved device which, by virtue of its design and components, would be able to overcome some of the aforementioned prior art problems.

SUMMARY OF THE INVENTION

The object of the present invention is to provide a finger protecting device which satisfies some of the above-mentioned needs and which is thus an improvement over other related protecting devices and/or methods known in the prior art.

In accordance with the present invention, the above object is achieved, as will be easily understood, with a finger protecting device such as the one briefly described herein and such as the one exemplified in the accompanying drawings.

According to the present invention, there is provided a finger protecting device for protecting at least one finger of a hand of a user of the device against the occurrence of chafing resulting from rubbing of said at least one finger against a shaft when practicing a sport with the shaft, the finger protecting device comprising:

a sleeve removably mountable onto a thumb of the hand, the sleeve being shaped and sized for covering a substantial portion of the thumb, the sleeve having opposite front and rear surfaces, the front surface being positioned before a digital area of the thumb when the sleeve is mounted onto the thumb for acting as a barrier between the thumb and the shaft, thereby protecting the thumb against the occurrence of chafing resulting from rubbing against the shaft, the sleeve further having first and second opposite ends, the second end being open-ended for allowing the thumb to be inserted into the sleeve through said second end; and fastening means operatively connected to the sleeve for selectively adjusting and fastening the sleeve onto the thumb when mounted thereon.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF A PREFERRED EMBODIMENT OF THE INVENTION

Figure 1:
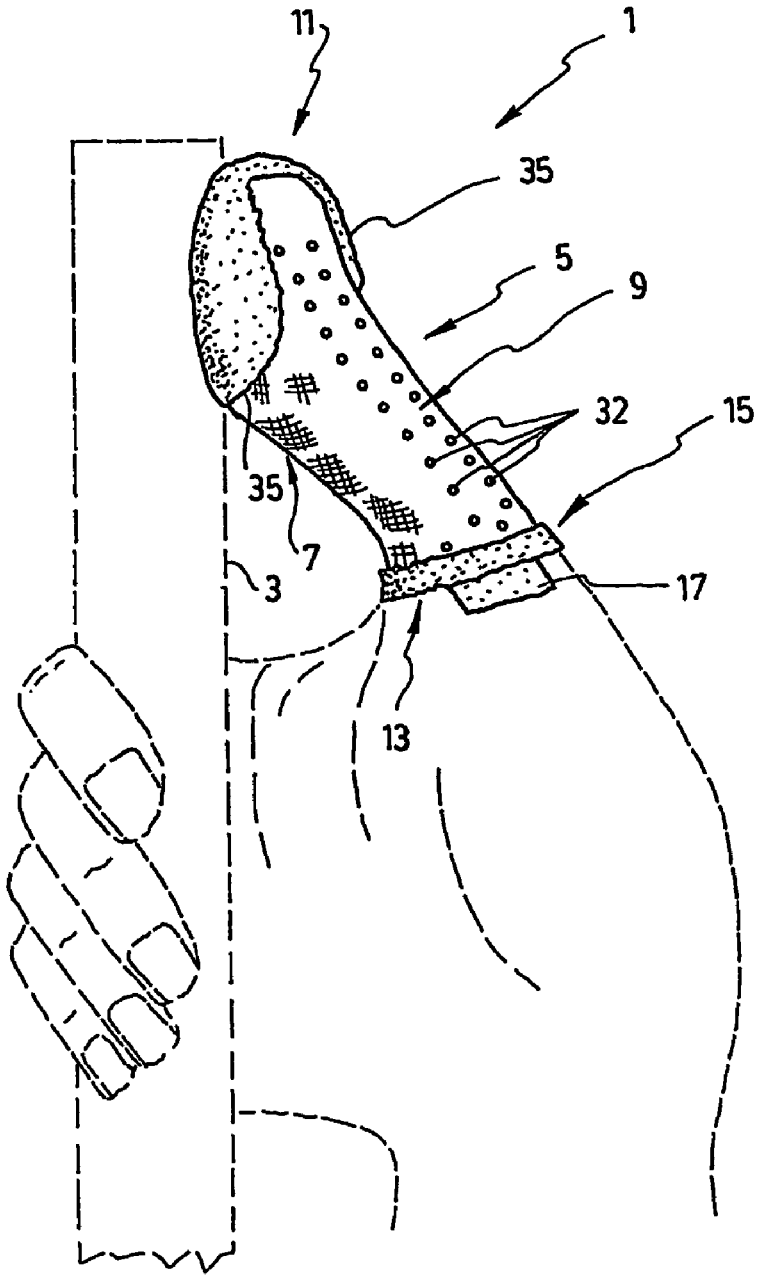
FIG. 1 is a perspective side view of a hand operating a shaft and being provided with a finger protecting device according to a first preferred embodiment of the invention, said finger protecting device being shown resting against the shaft and being used for protecting the thumb of the hand.

In the following description, the same numerical references refer to similar elements. The embodiments shown in the accompanying figures are preferred.

In addition, although the preferred embodiment of the present invention as illustrated in the accompanying drawings comprises various components and although the preferred embodiment of the finger protecting device 1 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the finger protecting device 1 and corresponding parts according to the present invention, as briefly explained herein, without departing from the scope of the invention.

Broadly described, the present invention, as shown in the accompanying drawings, relates to a finger protecting device 1 for protecting at least one finger of a hand of a user of the device 1 against the occurrence of chafing resulting from rubbing of said at least one finger against a shaft 3 when practicing a sport with the shaft 3. The finger protecting device 1 comprises a sleeve 5 removably mountable onto a thumb of the hand, the sleeve 5 being shaped and sized for covering a substantial portion of the thumb. As better shown in FIGS. 1 and 2, the sleeve 5 has opposite front and rear surfaces 7,9, the front surface 7 of the sleeve 5 being positioned before a digital area of the thumb when the sleeve 5 is mounted onto the thumb for acting as a barrier between the thumb and the shaft 3, thereby protecting the thumb against the occurrence of chafing resulting from rubbing against the shaft 3. As better shown in FIGS. 1-5, the sleeve further has first and second opposite ends 11,13, the first end 11 of the sleeve 5 being the one destined to be closer to the fingertip of the thumb when the device 1 is mounted thereon, whereas the second end 13 of the sleeve 5 being the one destined to be closer to the palm. As can be easily understood, the second end 13 is open-ended for allowing the thumb to be inserted into the sleeve 5 through said second end 13. According to the present invention, the finger protecting device 1 also comprises fastening means 15 operatively connected to the sleeve 5 for selectively adjusting and fastening the sleeve 5 onto the thumb when mounted thereon.

As illustrated in the accompanying drawings, the sleeve 5 is preferably a membrane shaped and sized to be mounted about at least a portion of at least one finger (e.g. the thumb) of a user and to provide a protecting layer between said portion of the at least one finger of the user and a shaft 3 against which the finger rests. Preferably, the membrane is shaped and sized to snugly fit the entire finger (or a suitable portion thereof) of a user, and may take on various geometrical configurations, as shown in the accompanying drawings. Preferably, the membrane is made of a suitable material, such as leather for example, and/or with a component preferably in the form of an elastic ("stretchable"), breathable, perforated, skintight material, such as spandex, nylon, polyester, and the like, to conform substantially to the shape of the portion of each finger that it covers and prevent movement that can cause chafing or blistering of the latter. Other suitable textile materials, whether made of synthetic and/or natural fibers, may be used for the sleeve 5 of the finger protecting device 1, as also apparent to a person skilled in the art.

Figure 2:
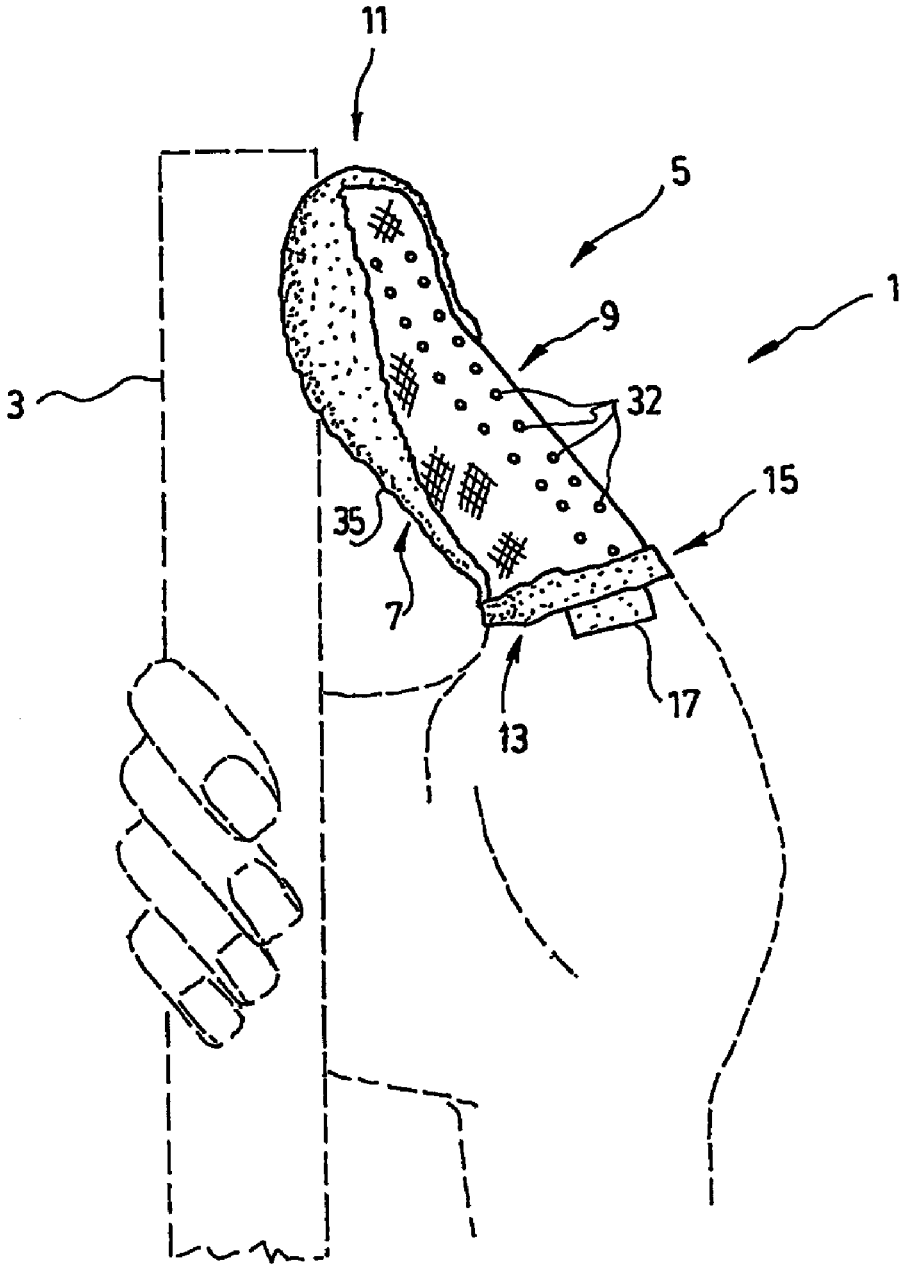
FIG. 2 is another perspective side view of a hand operating a shaft and being provided with a finger protecting device according to yet another preferred embodiment of the invention, said finger protecting device being shown resting against the shaft and being used for protecting the thumb of the hand.

Preferably, as better shown in FIGS. 1 and 2, the device 1 comprises at least one tab 17 securely affixed to the sleeve 5 for pulling thereon so as to facilitate the mounting of the device 1 onto the thumb and also facilitate the removal thereof from the thumb via a corresponding pull of the tab 17. The tab 17 is preferably located at the bottom of the finger protecting device 1, i.e. near its second end 13, to grab in aiding to slide the finger protecting device 1 on and off of a given finger, the thumb for example, as illustrated in the embodiments of FIGS. 1 and 2.

Preferably also, as aforementioned, the finger protecting device 1 is provided with suitable fastening means 15 for securing the finger protecting device 1 onto the thumb of the user. The fastening means 15 are preferably provided about the second end 13 of the sleeve 5 for selectively and adjustably constricting said second end 13 onto the thumb so as to adjust and fasten the sleeve 5 onto the thumb. These fastening means 15 may consist of various embodiments, such as an elastic band, a Velcro™ strap assembly, a buckle and strap assembly, snap assemblies, and the like, as apparent to a person skilled in the art, so long as they properly ensure a maintaining of the finger protecting device 1 about the given finger of the user, to adjust for snugness. A preferred embodiment of fastening means will be described in greater detail hereinbelow when in reference to the possibility of using a wristband portion with the finger protecting device 1.

As can be easily understood, several modifications could be made to a thumb protecting device 1 according to the present invention without departing from the scope of the present invention. For example, according to the present invention, the thumb protecting device 1 (or protective device 1 used for another single finger) is preferably made in a symmetrical configuration so as to enable a given thumb protecting device 1 to be used on either the thumb of a left hand or a right hand, but as may be appreciated, the finger protecting device 1 may be altered so as to be customized to a particular hand, whether left or right, as can be easily understood when referring to FIGS. 1-5 and as apparent to a person skilled in the art.

Figure 6:
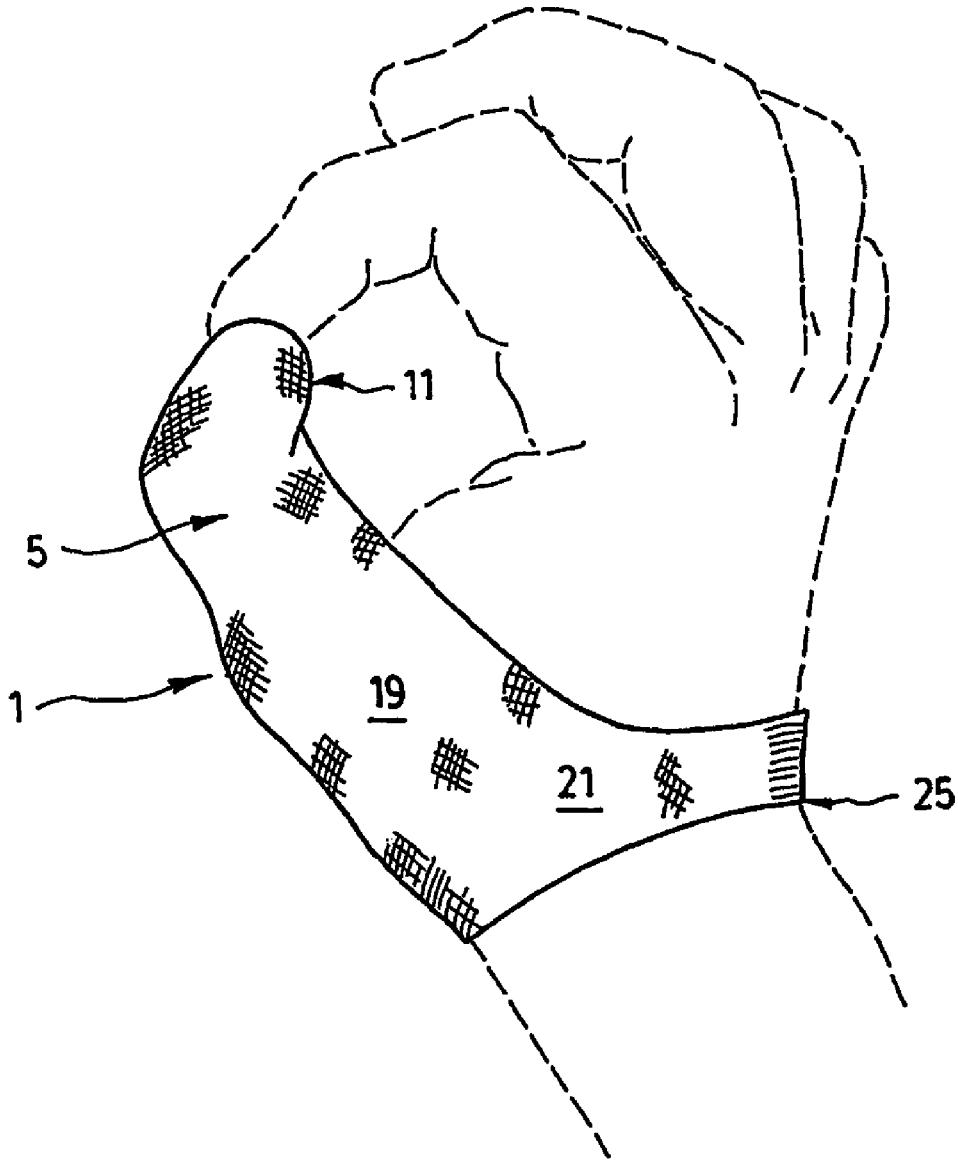
FIG. 6 is a perspective view of a hand provided with a finger protecting device according to yet another preferred embodiment of the invention.
Figure 7:
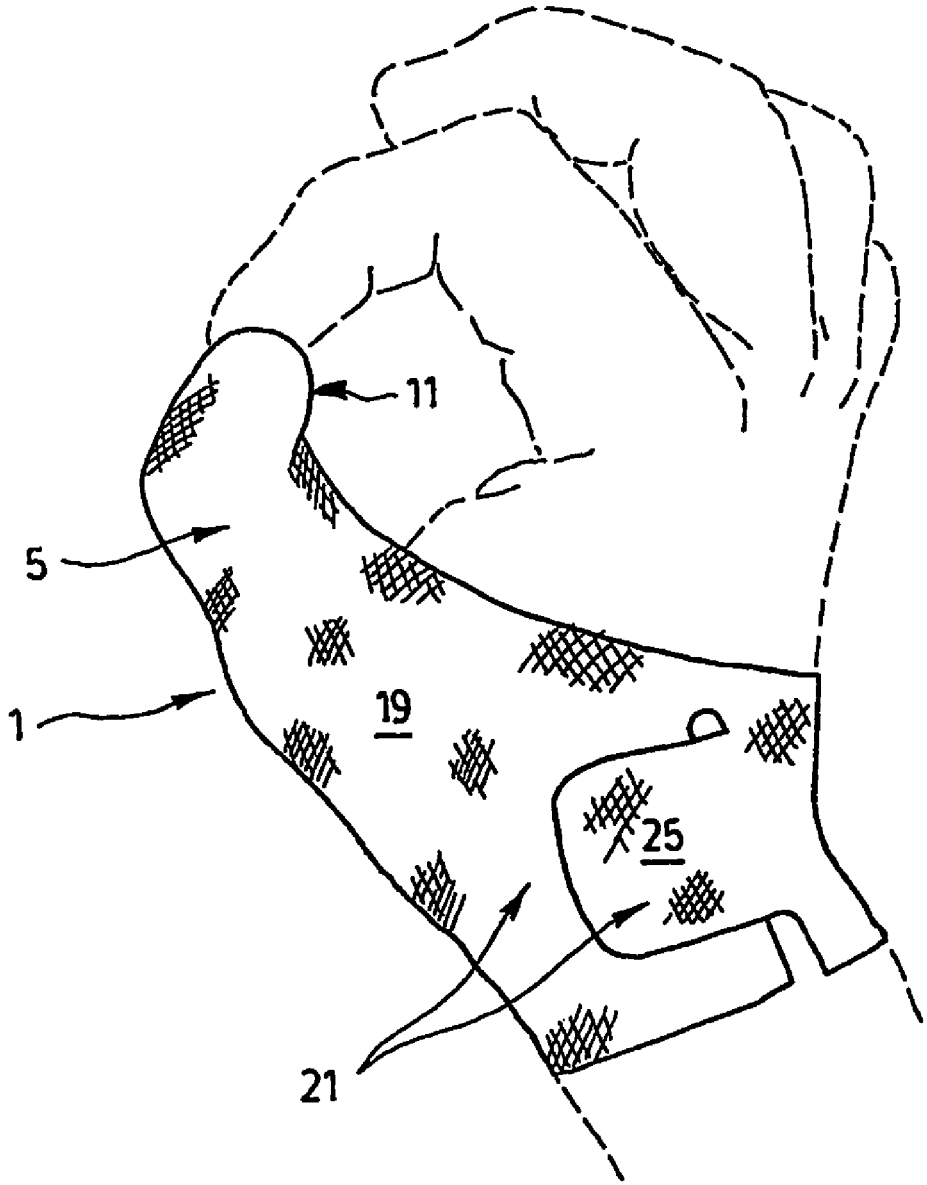
FIG. 7 is a perspective view of a hand provided with a finger protecting device according to yet another preferred embodiment of the invention.
Figure 8:
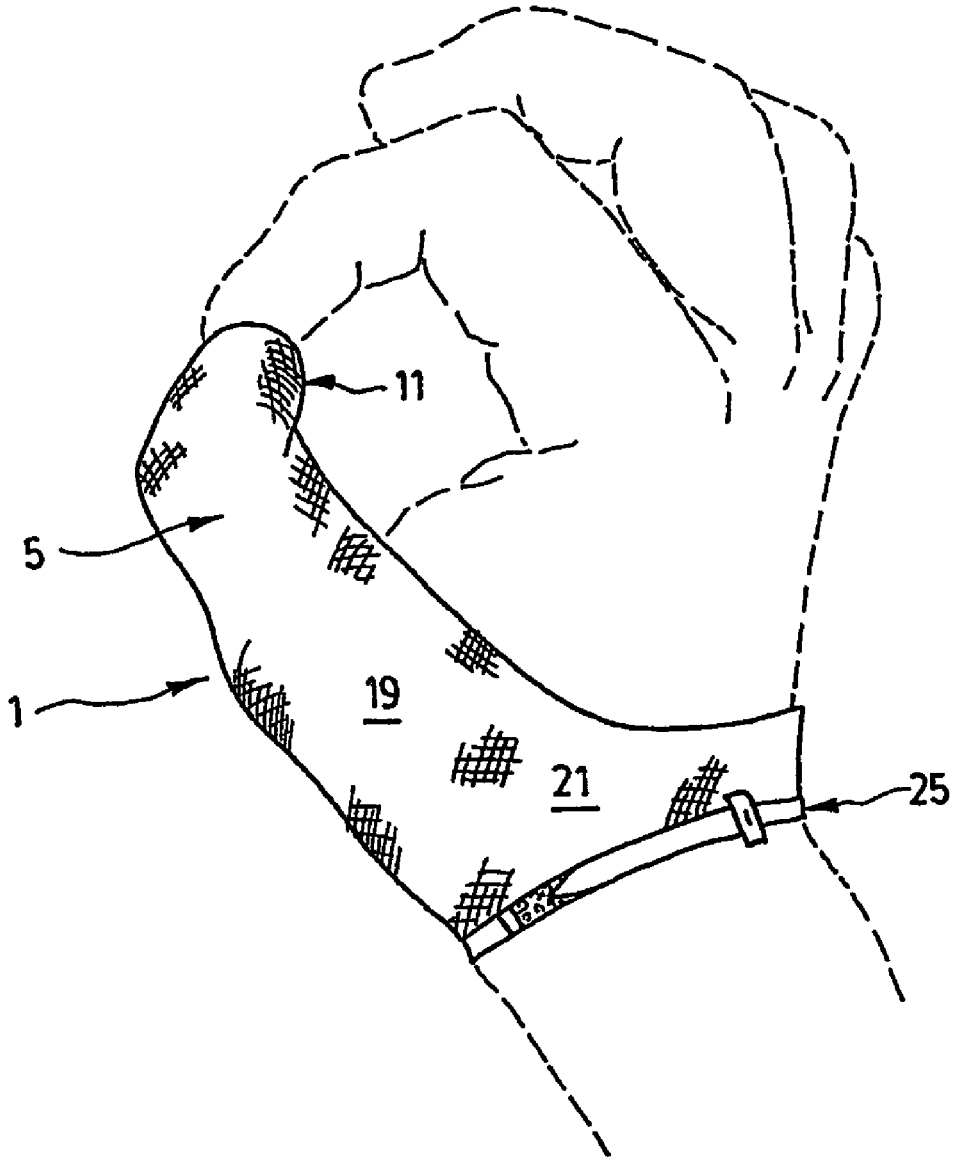
FIG. 8 is a perspective view of a hand provided with a finger protecting device according to yet another preferred embodiment of the invention.
Figure 9:
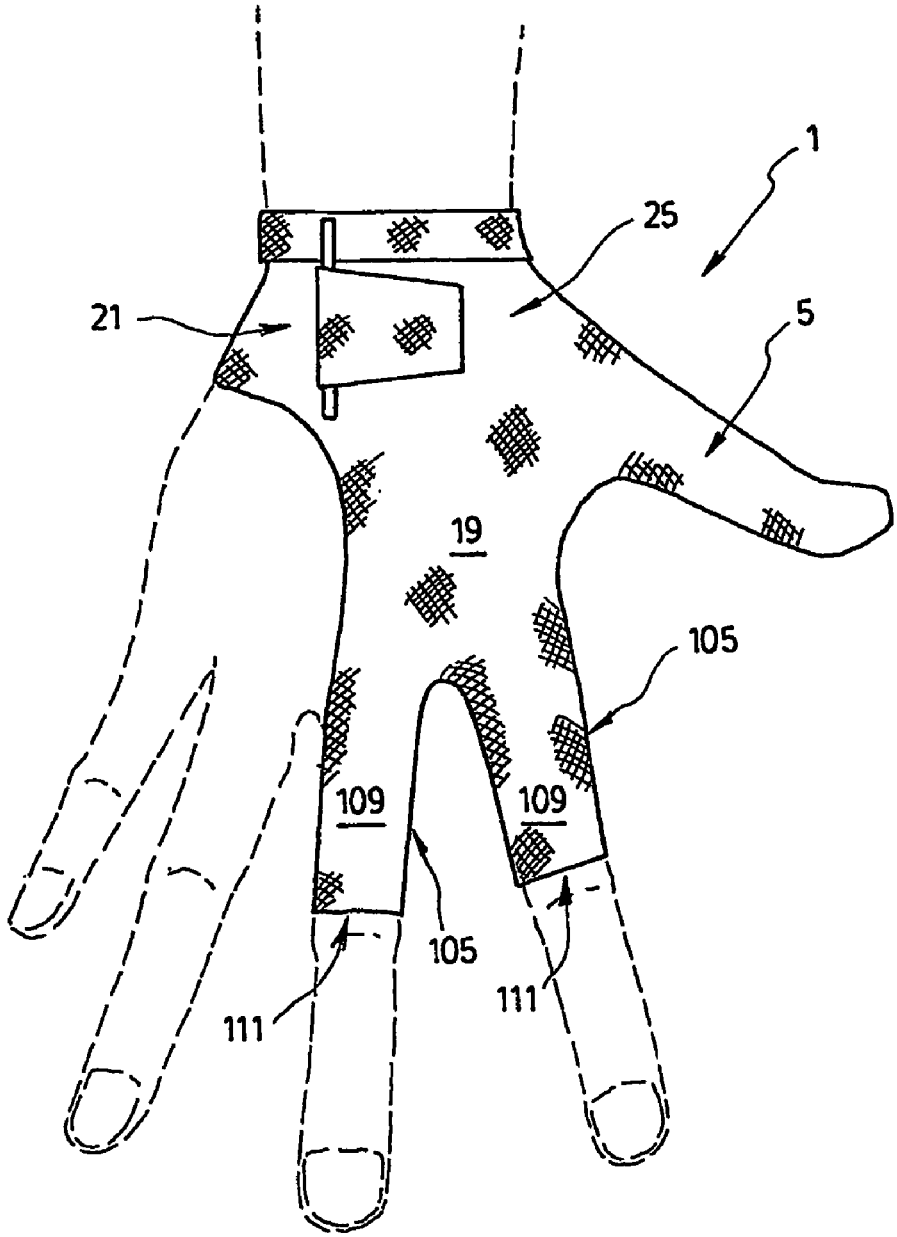
FIG. 9 is a plan view of a hand provided with a finger protecting device according to yet another preferred embodiment of the invention.
Figure 10:
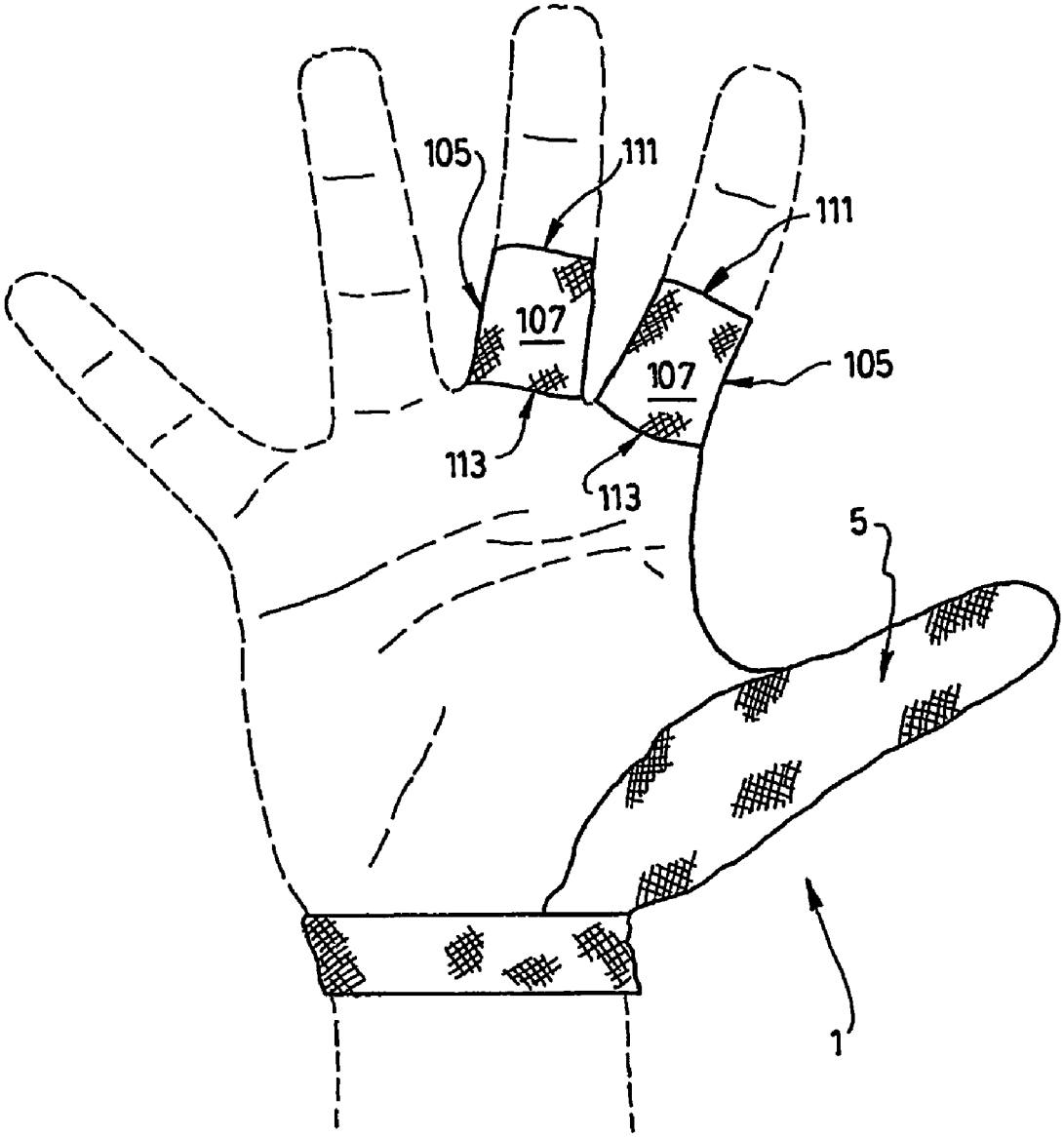
FIG. 10 is a rear view of what is shown in FIG. 9.
Figure 11:
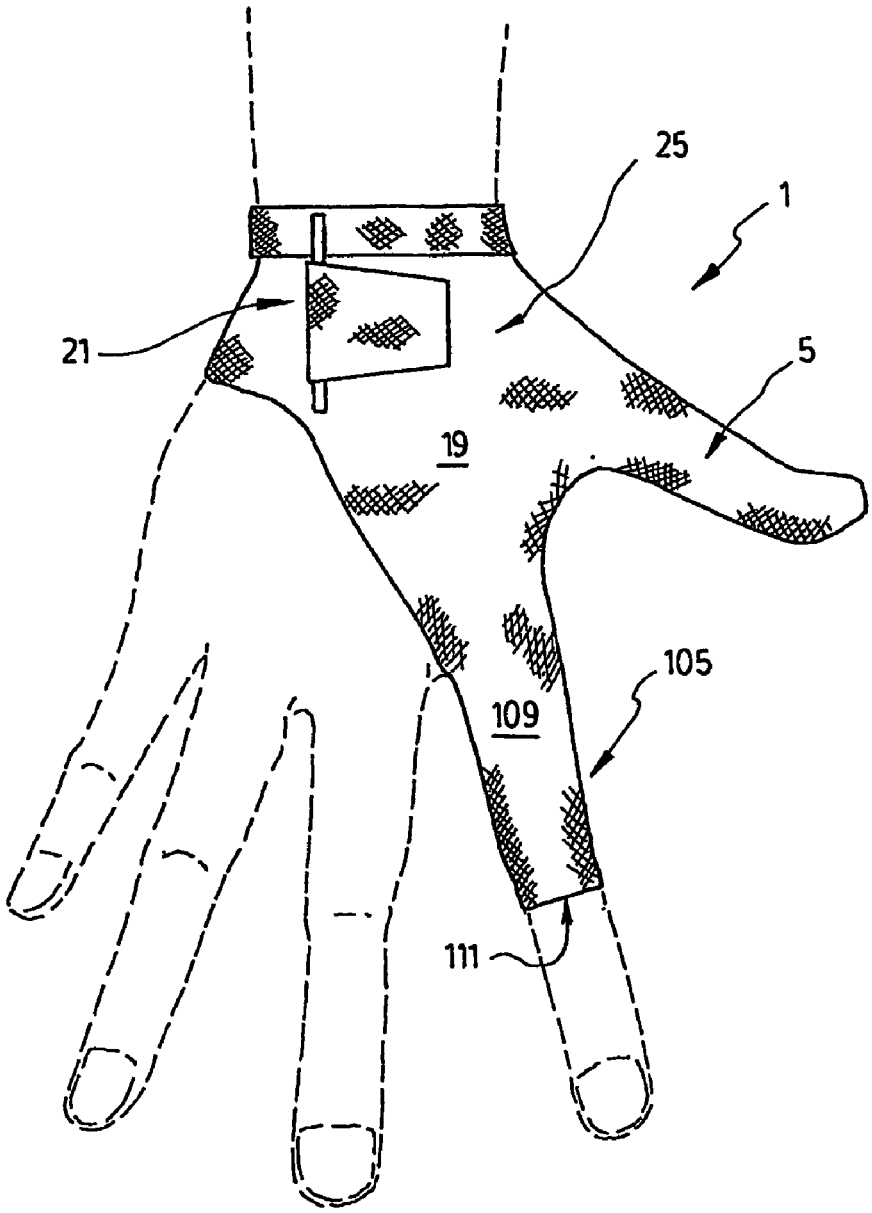
FIG. 11 is a plan view of a hand provided with a finger protecting device according to yet another preferred embodiment of the invention.
Figure 12:
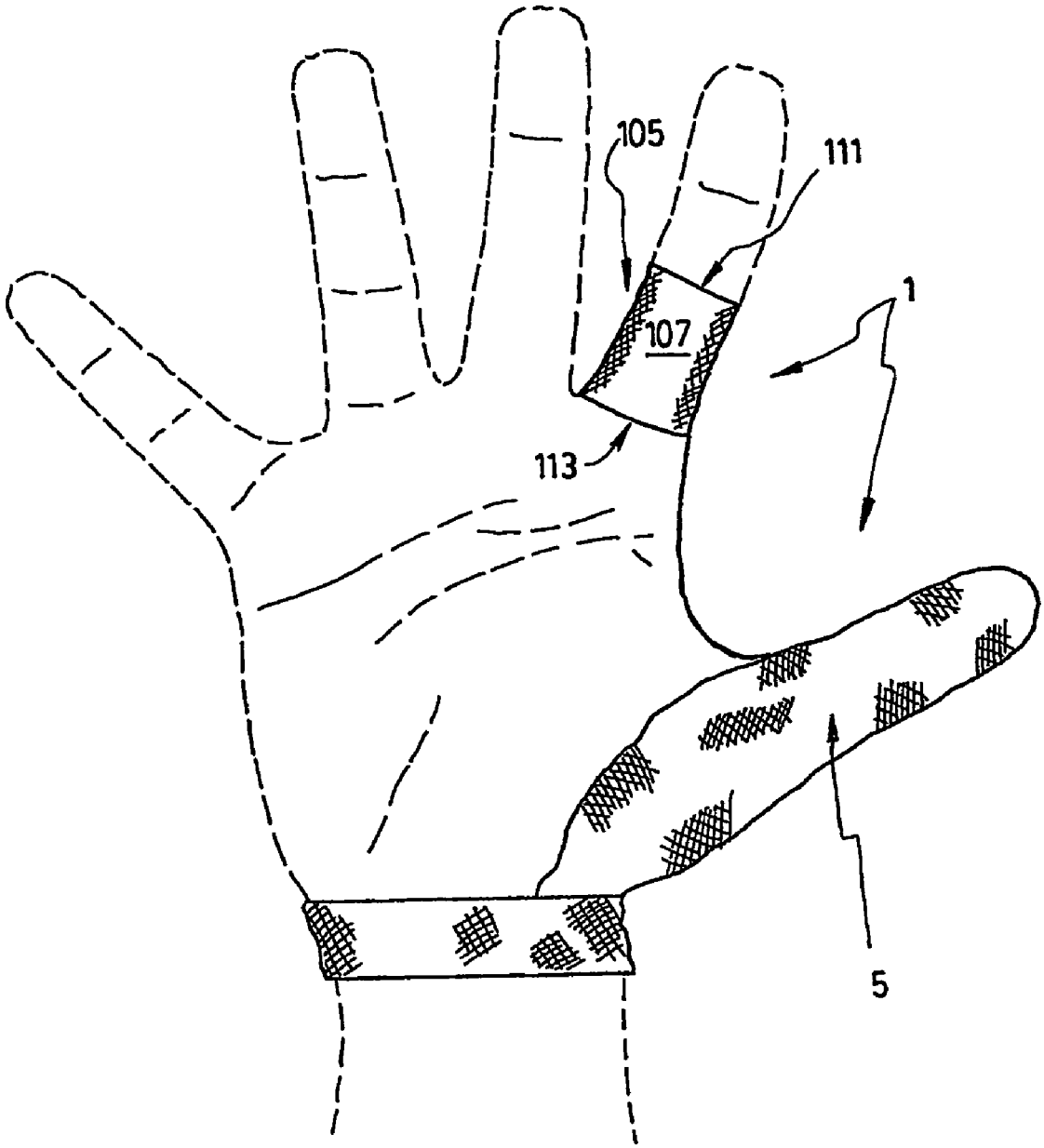
FIG. 12 is a rear view of what is shown in FIG. 11.
Figure 13:
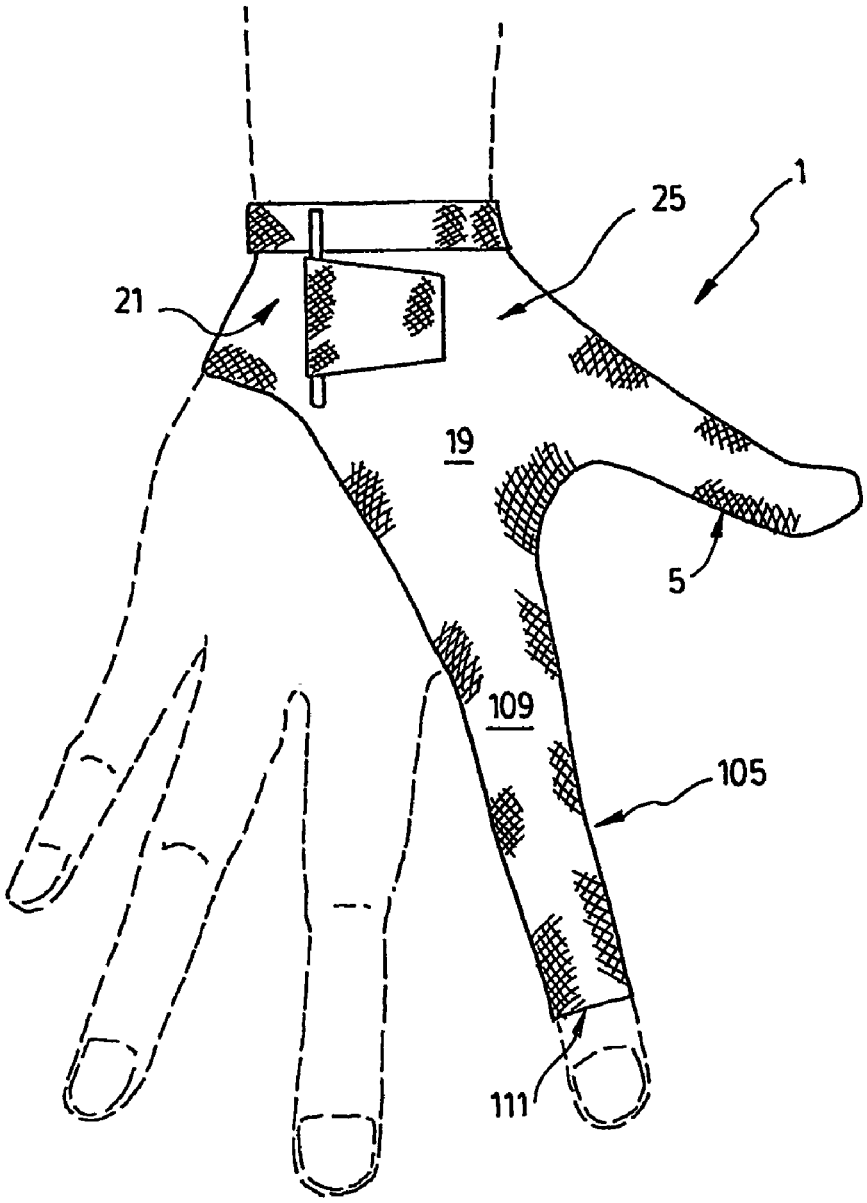
FIG. 13 is a plan view of a hand provided with a finger protecting device according to yet another preferred embodiment of the invention.
Figure 14:
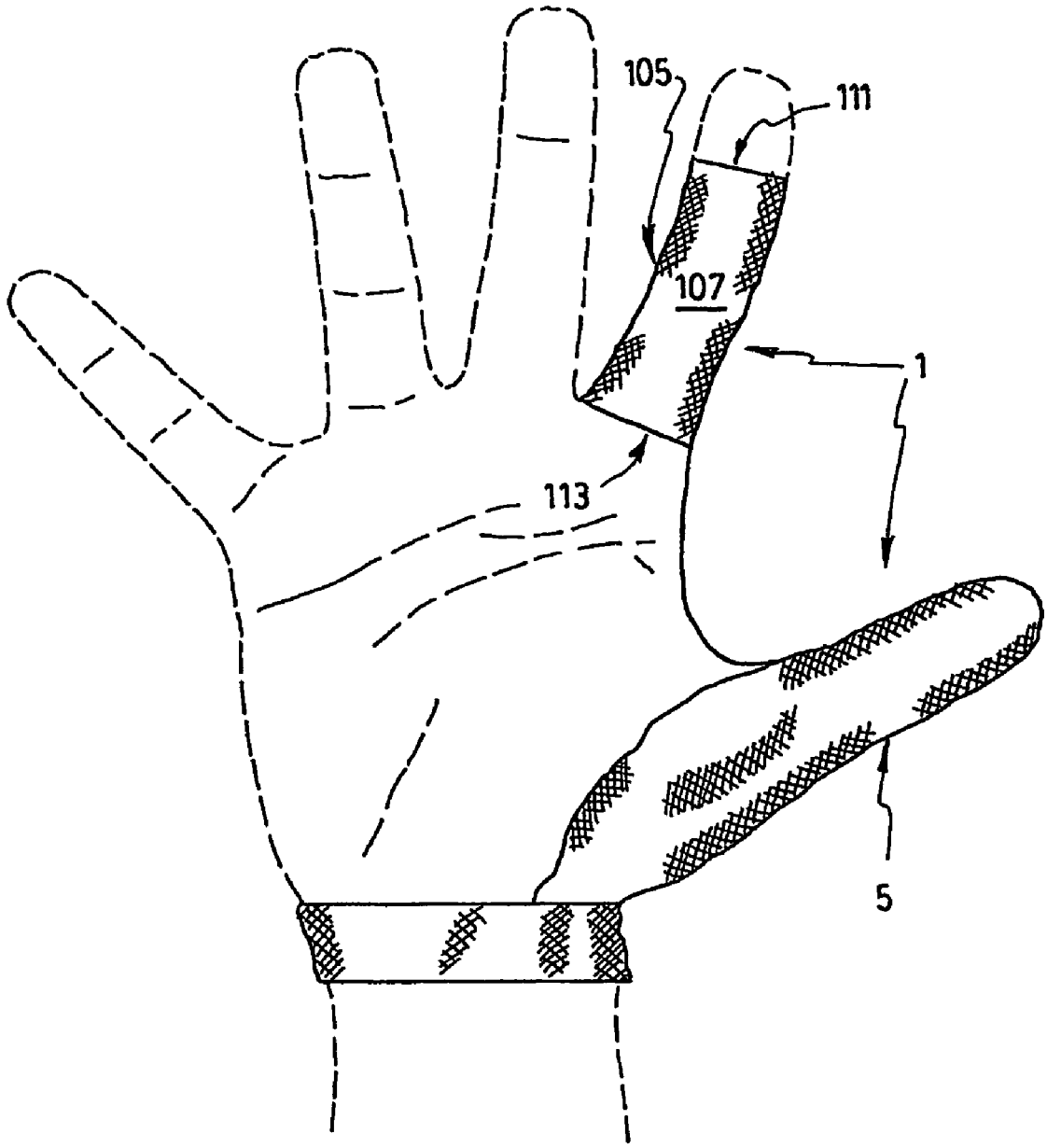
FIG. 14 is a rear view of what is shown in FIG. 13.
Figure 15:
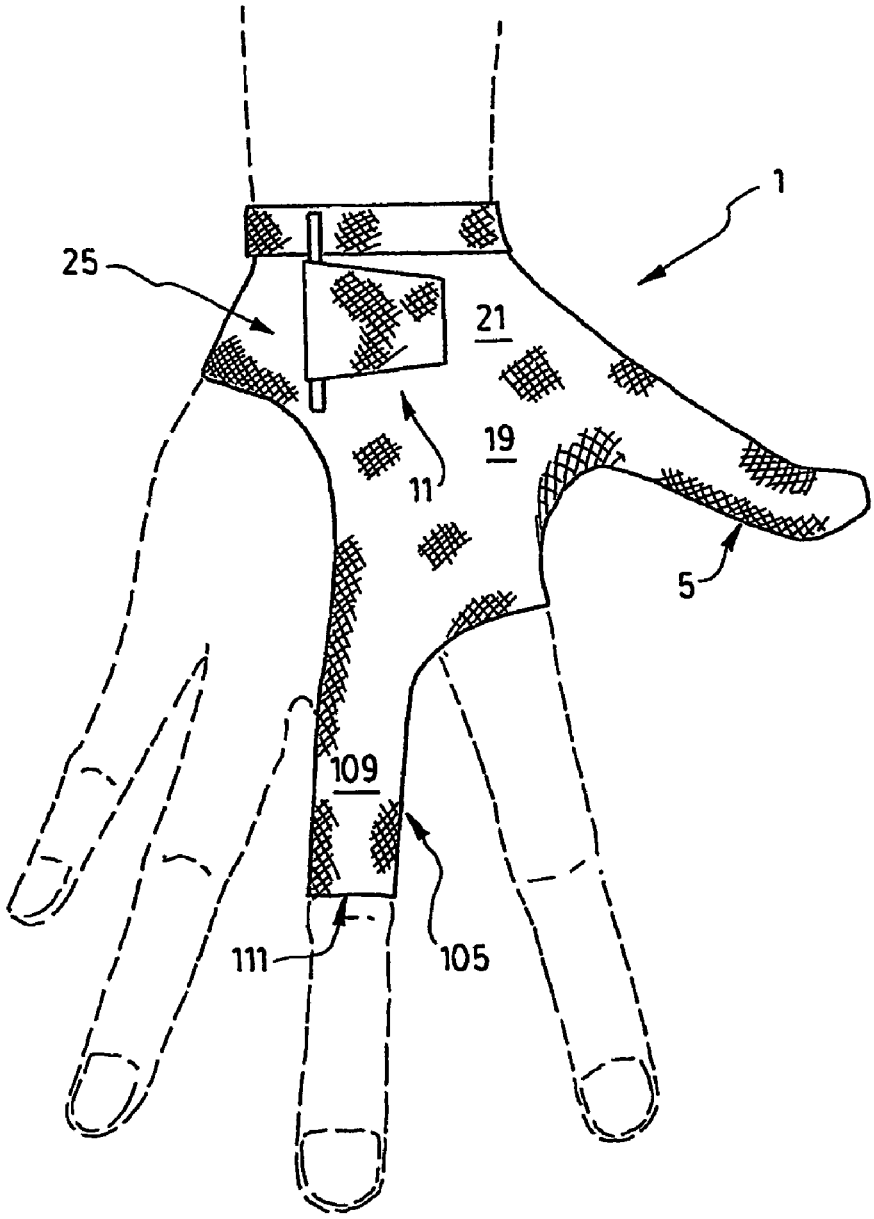
FIG. 15 is a plan view of a hand provided with a finger protecting device according to yet another preferred embodiment of the invention.
Figure 16:
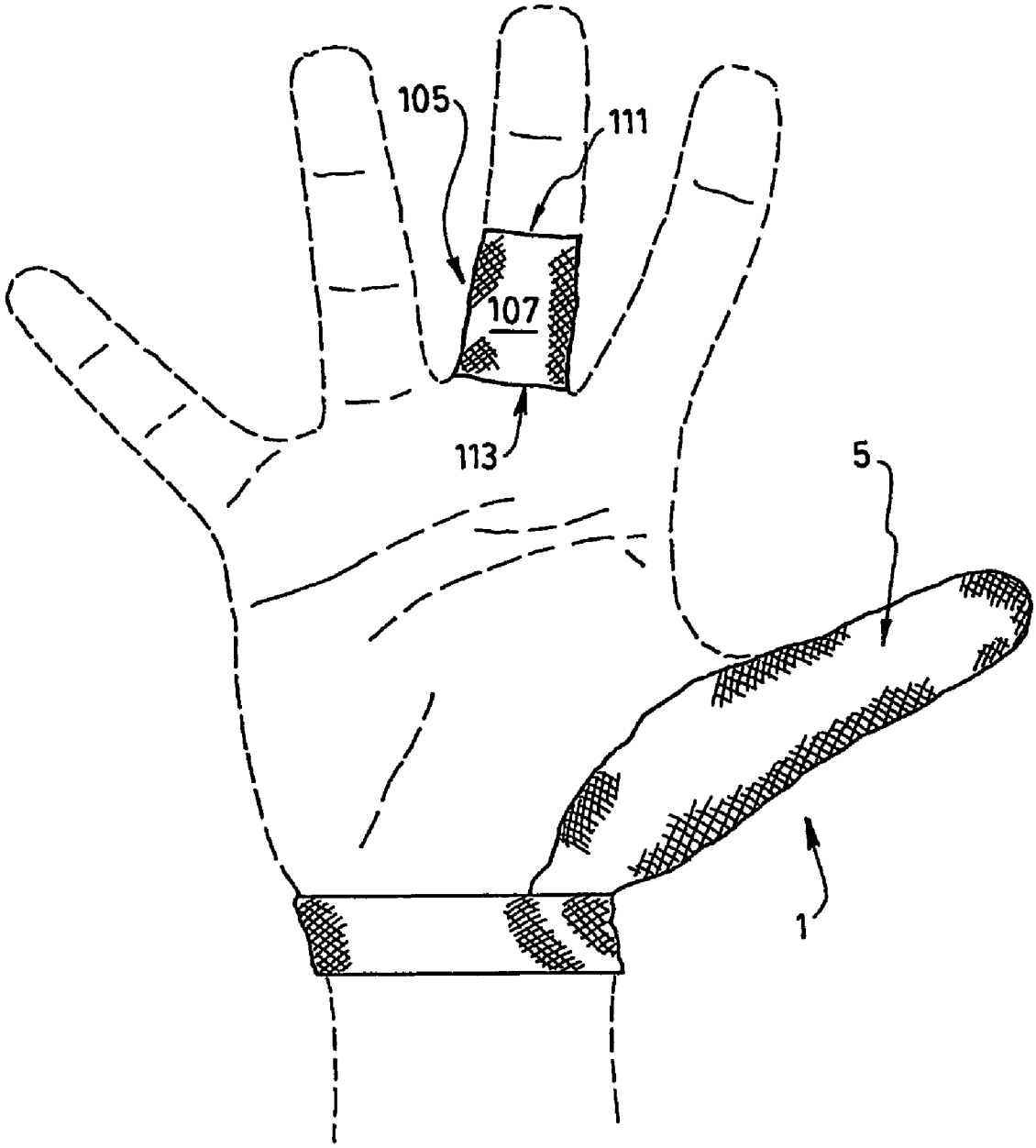
FIG. 16 is a rear view of what is shown in FIG. 15.
Figure 17:
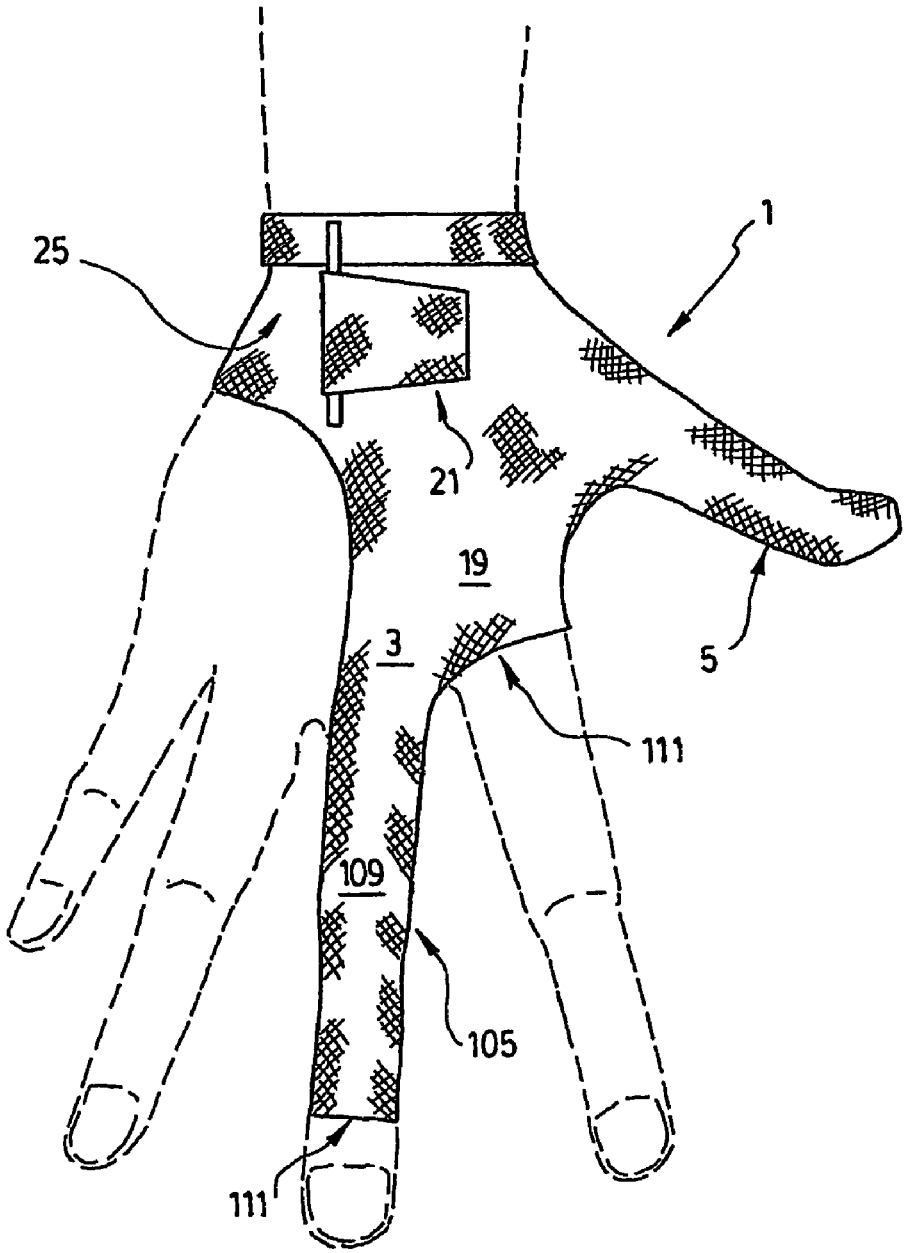
FIG. 17 is a plan view of a hand provided with a finger protecting device according to yet another preferred embodiment of the invention.
Figure 18:
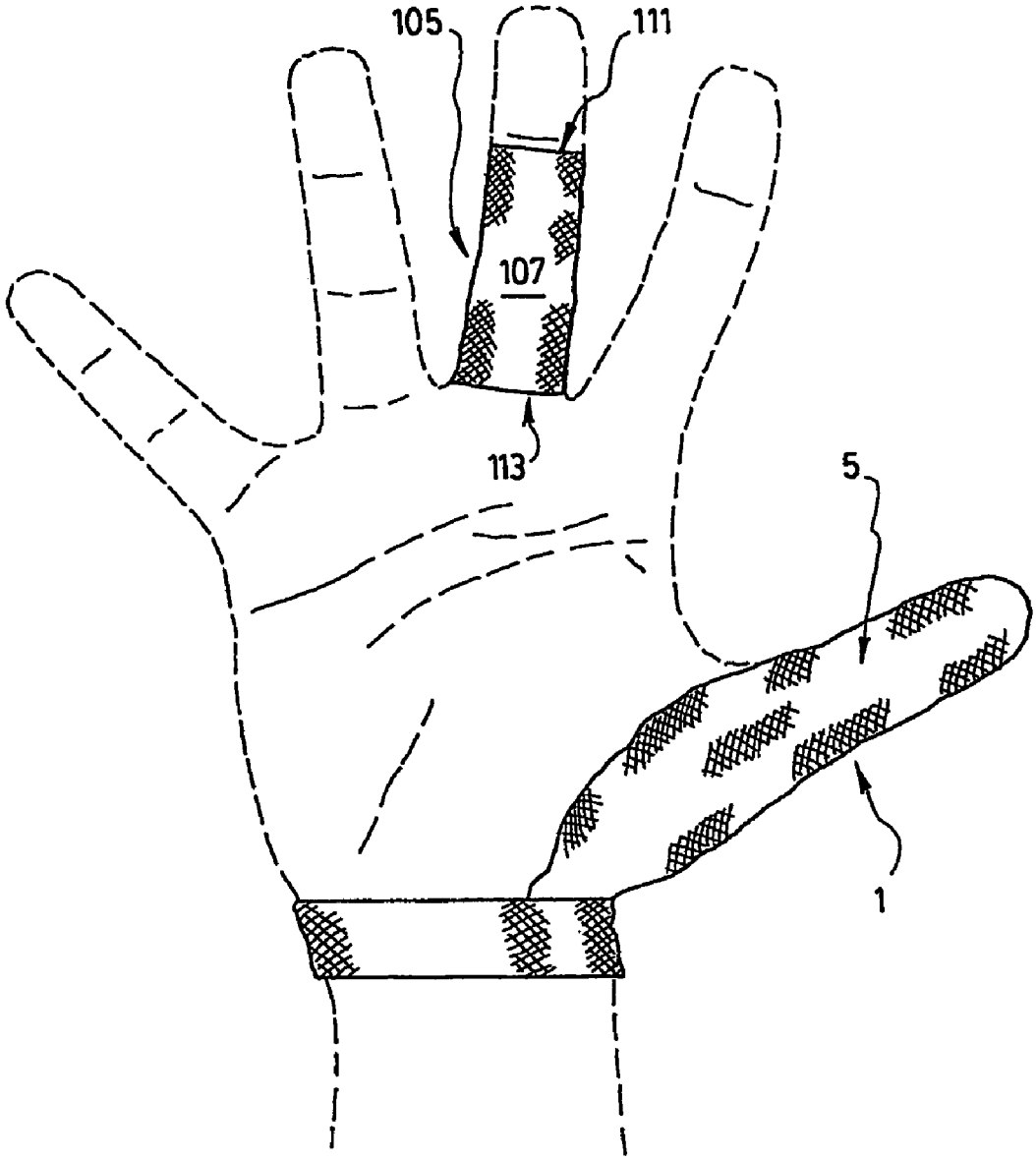
FIG. 18 is a rear view of what is shown in FIG. 17.
Figure 19:
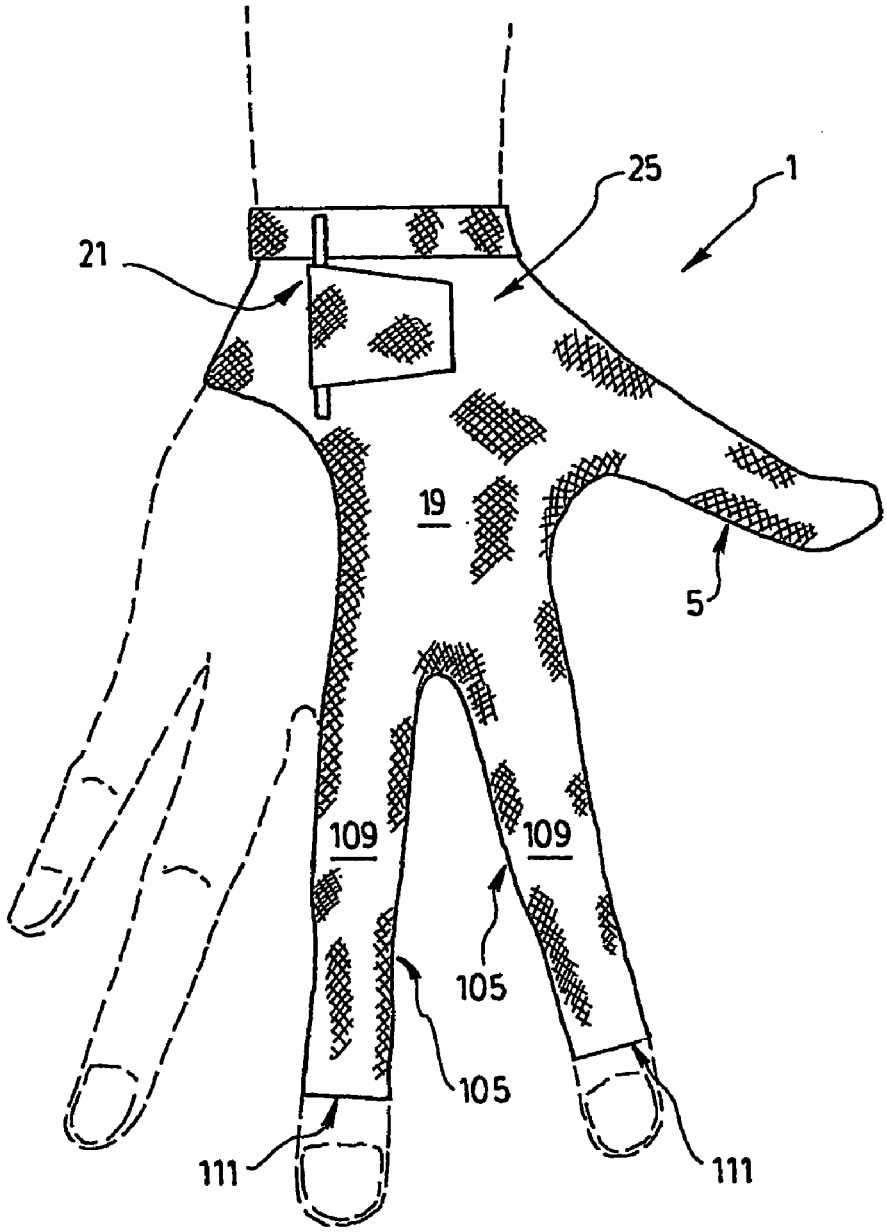
FIG. 19 is a plan view of a hand provided with a finger protecting device according to yet another preferred embodiment of the invention.
Figure 20:
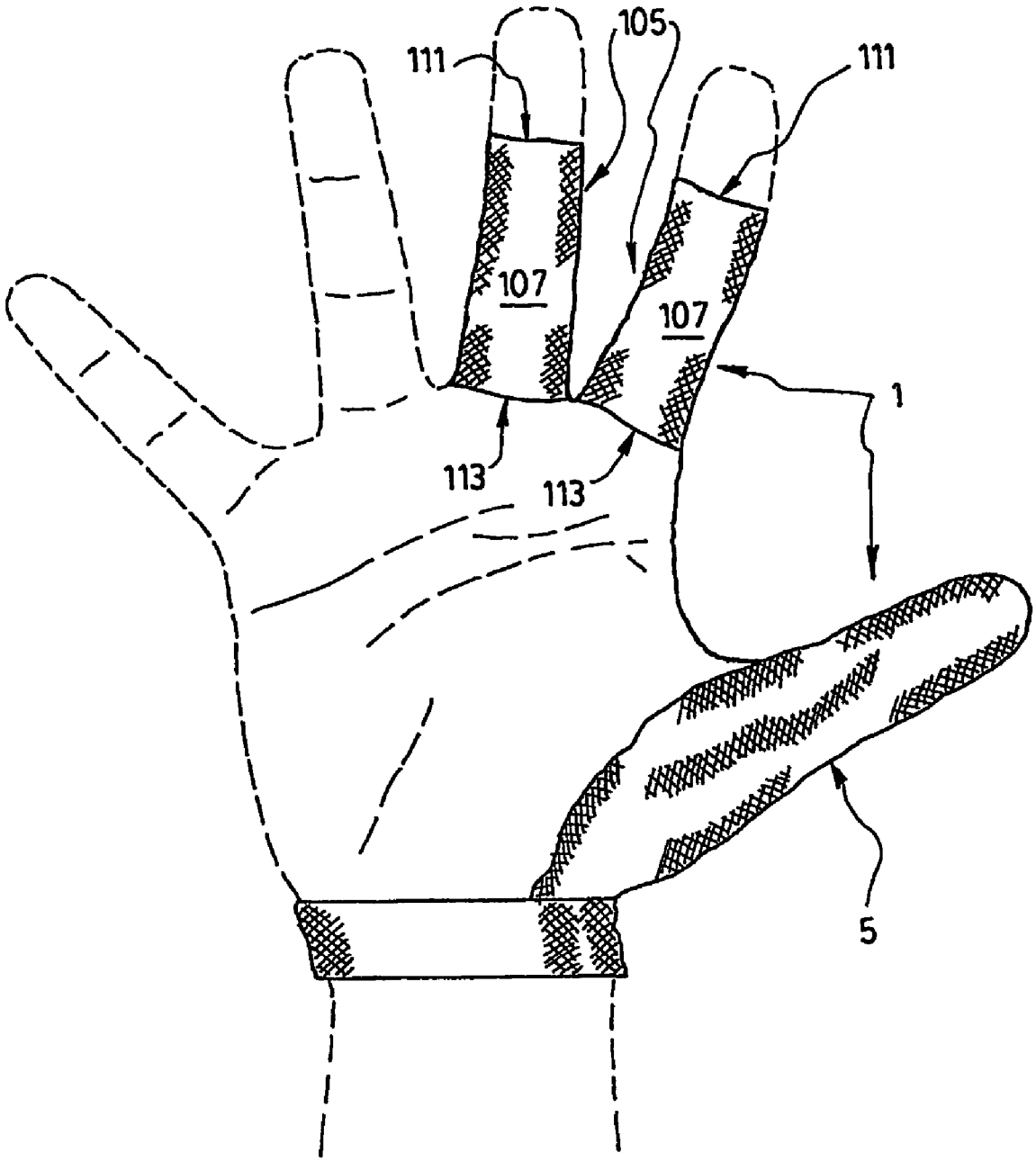
FIG. 20 is a rear view of what is shown in FIG. 19.
Figure 21:
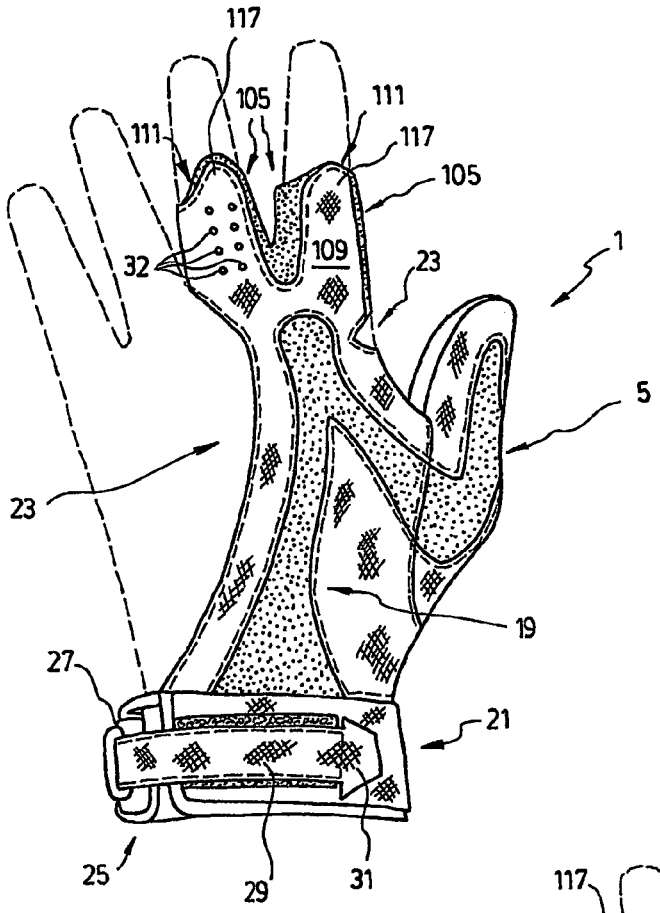
FIG. 21 is a plan view of a hand provided with a finger protecting device according to yet another preferred embodiment of the invention, the wristband portion of the device being shown in a closed configuration.
Figure 22:
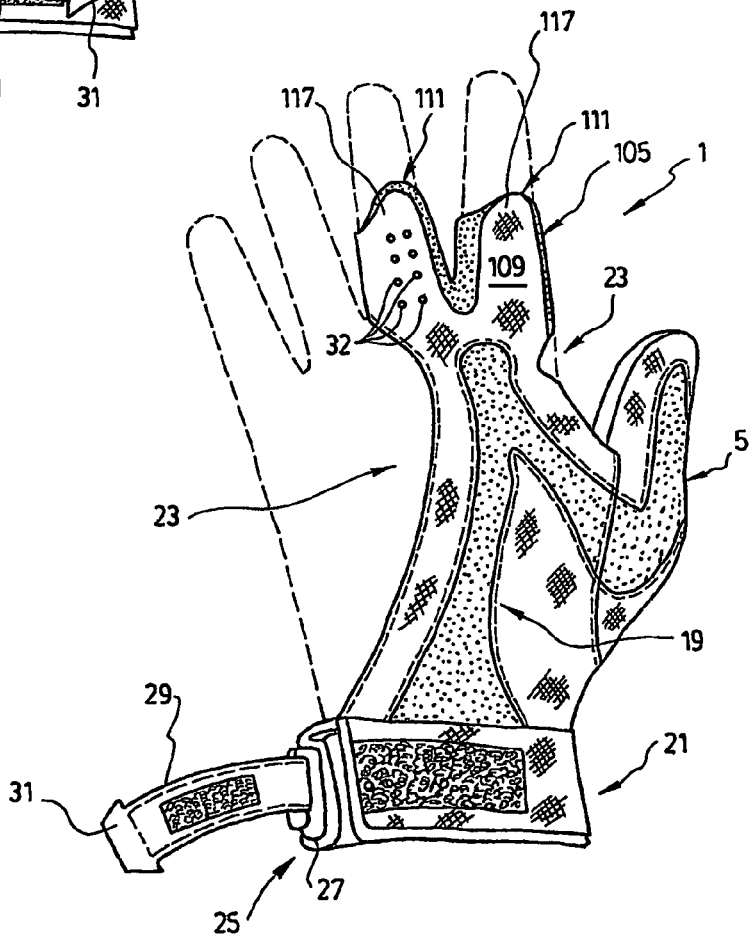
FIG. 22 is another view of what is shown in FIG. 21, the wristband portion of the device being now shown in an opened configuration.
Figure 24:
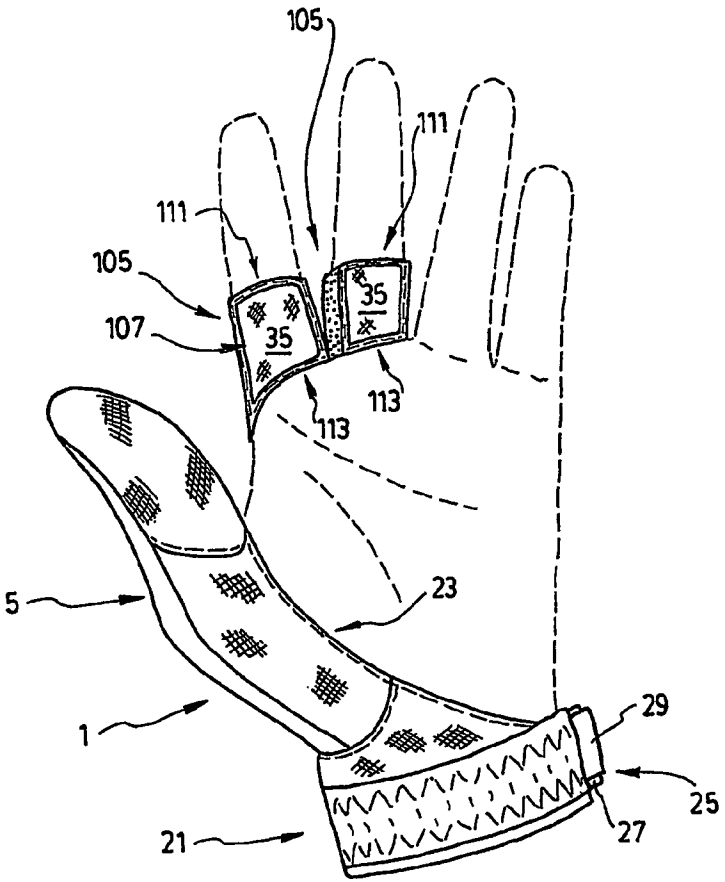
FIG. 24 is a rear view of what is shown in FIG. 21.
Figure 23:
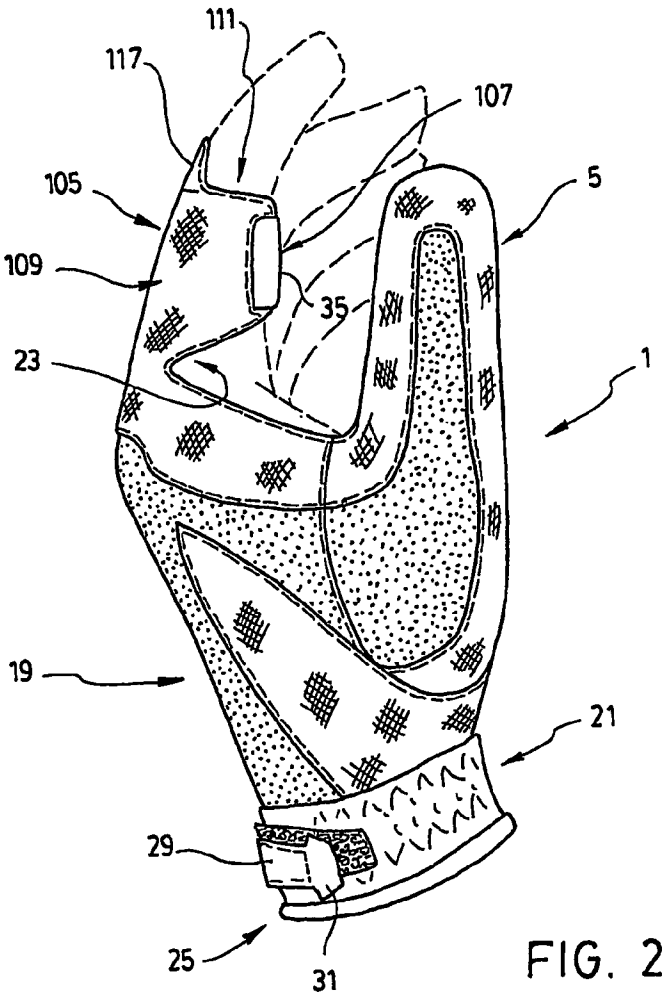
FIG. 23 is a side view of what is shown in FIG. 21.

As can also be easily understood, several other modifications could be made to the present finger protecting device 1 without departing from the scope of the invention. Indeed, as shown in FIGS. 6-8, for example, the finger protecting device 1 may be provided with extension and/or wristband portions 19,21 which are preferably positioned about a part (such as the back of the hand, a wrist, or simply another finger, etc.) of the hand of a user on which the finger protecting device 1 is used. These portions 19,21 of the finger protecting device 1 are preferably intended to provide added securement of the finger protecting device 1 onto the hand with which it cooperates, while leaving a substantial portion thereof (e.g. palm, fingers, fingertips, etc.) free of any material so as to have a better "feel" of the golf club, and thus a better "control" thereof. Among many other advantages, these portions 19,21 of the finger protecting device 1 prevent the latter from substantially rotating about the finger (e.g. thumb) of a user, thereby ensuring, for example, proper positioning of padding that the device 1 may contain, as will be explained hereinbelow. The wristband portion 21 may simply consist of an elastic rope for example (not shown) affixed to the thumb protecting device 1 and hooked onto a corresponding part of the hand for improving securement of the finger protecting device 1 on said hand. Preferably though, the extension and wristband portions 19,21 of the finger protecting device 1 are suitable membranes or sections made integral to the finger protecting device 1 itself, that is, according to the preferred embodiments of the invention exemplified in FIGS. 6-8, the finger protecting device 1 and its different portions 5,19,21 are preferably made of one single piece and one single material. Preferably, as shown, it is a peripheral portion of the second end 13 of the sleeve 5 destined to be mounted onto the thumb which is provided with an extension portion 19, said extension portion 19 being provided with a wristband portion 21 being shaped and sized for removably mounting about a wrist of the hand of the user of the device 1, for the reasons mentioned above. As aforementioned, and as illustrated in the accompanying drawings, the extension portion 19 is preferably shaped and sized to cover a portion of the back of the hand when the device 1 is mounted thereon, and preferably also, the extension portion 19 comprises curved section(s) 23 for preventing bunching up of the extension portion 19 and other corresponding portions connected thereto when the device 1 is bent by the hand, as can be easily understood by a person skilled in the art when referring to FIGS. 21-23.

As better shown in these figures, the modified version of the thumb protecting device 1 preferably extends down from the thumb and onto corresponding parts of the hand, and secures itself snuggly around the wrist. As also shown, the wristband portion 21 is preferably provided with suitable fastening means 25, such as the ones briefly described above for example, for securing the finger protecting device 1 and corresponding portions onto the hand of a user. Indeed, the wristband portion 21 is preferably provided with fastening means 25 positioned about a segment of the wristband portion 21 for selectively adjusting and fastening the wristband portion 21 onto the wrist when mounted thereabout. The fastening means 25 which may be used for the wristband portion 21 may be various, as apparent to a person skilled in the art.

For example, as better shown in FIG. 6, the fastening means 25 may be integrated to the wristband portion 21 itself, and for example simply consist of an elastic band for mounting about the wrist or forearm so as to provide an additional securing and fastening of the device 1 onto the hand. As better shown in FIG. 7, the finger protecting device 1 may be provided with a slit in the membrane that offers greater room for a hand to enter the finger protecting device 1 and a Velcro™ strap as suitable fastening means 25 for holding that slit together once the hand is securely in place. As better shown in FIG. 8, the finger protecting device 1 may be provided with a buckle and strap assembly that is adjustable and conforms to the wrist. Other suitable alterations may be made to the finger protecting device 1 and corresponding portions 19,21 illustrated in the accompanying drawings to increase the securement and the comfort thereof, as apparent to a person skilled in the art.

According to the preferred embodiment of the present invention illustrated in FIGS. 21-24, the wristband portion 21 is operable between opened and closed configurations, and the wristband portion 21 further comprises first and second end portions for encircling the wrist, the first and second end portions being removably connectable to one another via fastening means 25 such as the above-described. More particularly, according to this preferred embodiment of the invention illustrated in FIGS. 21-24, the fastening means 25 comprise a buckle 27 provided on the first end portion of the wristband portion 21, and a strap 29 securely affixed onto the second end portion of the wristband portion 21, the strap 29 being insertable into the buckle 27 and foldable thereabout so as to be removably secured onto the second end portion via suitable connecting means, such as the ones mentioned hereinabove, and as apparent to a person skilled in the art, so as to be able to operate the wristband portion 21 in the closed configuration, as better shown in FIG. 21. If desired, the alternate could also be possible, that is, the buckle 27 could be provided on the second end portion of the wristband portion 21, and the strap 29 could be securely affixed to the first end portion, so as to have the strap 29 foldable and secured onto an opposite side of the wristband portion 21, as apparent to a person skilled in the art. Preferably also, the extremity of the strap 29 is provided with an abutment flange 31 shaped and sized for preventing said extremity of the strap 29 from being removed from the buckle 27 when the wristband portion 21 is in the opened configuration, as can be easily understood when referring to FIG. 22.

There are several advantages that result from the above-discussed. Indeed, as may now better be appreciated, the above-mentioned preferred embodiment of the fastening means 25 enable the finger protecting: device 1 to be operated in an opened configuration so as to allow the insertion and the removal of the hand to and from the device 1, while preventing the strap 29 from detaching itself from the buckle 27, which is very advantageous, because otherwise, one would have to repeatedly insert the extremity of the strap 29 through the buckle 27 so as to operate the device in the closed configuration. Moreover, under normal circumstances, manipulation of the extremity of a conventional strap with a gloved hand, as is often the case in golfing, etc., would be particularly cumbersome, but this is resolved by virtue of the fact that the extremity of the strap 29 is provided with a widened abutment flange 31 which, not only prevents the strap 29 from detaching itself from the buckle 27, as aforementioned, but also is preferably shaped and sized suitably, as apparent to a person skilled in the art, for enabling to operate the fastening means 25 (i.e. the strap 29) very easily, quickly, and adjustably, even with a gloved hand, simply by pulling on the abutment flange 31 and adjusting the fastening means 25 accordingly. Indeed, this operation is also facilitated, by virtue of the widened abutment flange 31, irrespectively whether the hand operating the fastening means 25 is gloved or not.

It is worth mentioning that the above-described fastening means 25 with corresponding abutment flange 31 could also be used as fastening means 15 for the finger protecting device 1 exemplified in FIGS. 1-5.

As can be easily understood, several other modifications could be made to the finger protecting device 1 according to the present invention without departing from the scope of the invention. Indeed, as better shown in FIGS. 9-24, the device preferably comprises at least one other sleeve 105 operatively connected via an extension portion 19 to the sleeve 5 used for removably mounting onto the thumb of the hand, the at least one other sleeve 105 being removably mountable onto another finger of the hand (e.g. index finger, middle finger, or other finger). The at least one other sleeve 105 is preferably shaped and sized for covering a substantial portion of said another finger, and has opposite front and rear surfaces 107, 109, similar to those of the sleeve 5 used for the thumb. Indeed, as better shown in FIGS. 9-24, the front surface 107 is preferably positioned before a digital area of the other finger when the at least one other sleeve 105 is mounted onto the same for acting as a barrier between the another finger and the shaft, thereby protecting the another finger against the occurrence of chafing resulting from rubbing against the shaft. Each additional sleeve 105 preferably further comprises first and second opposite ends 111,113 similar to the ones of the sleeve 5 used for the thumb, each second end 113 being open-ended for allowing the other corresponding fingers to be inserted into each additional sleeve 105 through said corresponding second ends 113.

An important aspect of the present invention resides in the fact that the first end 111 of the at least one other sleeve 105 is open-ended so as to allow a portion of the another finger to extend therethrough, thereby enabling a user of the device 1 to have a proper "feel" of the shaft via the fingertips of his/her hands which are left exposed, as illustrated in the accompanying drawings. This is particularly advantageous when compared to other related devices known in the art which comprise closed-ended receptacles which do not enable the user to have a "feel" of the shaft via the fingertips. This is particularly undesirable in most sporting activities, namely in golfing for example.

In contrast, as shown in the accompanying drawings, the finger protecting device 1 may be devised to protect a plurality of fingers, other than just the thumb, while at the same time enabling the other fingers of the hand to have their fingertips exposed so as to have a proper "feel" of the shaft when holding the shaft. For the sake of clarity, the following description refers to a finger as having three knuckles, the first knuckle being the one located at the base of the finger, and as one moves towards the finger nail, the second knuckle being the next one, and the third knuckle being the one after that. Indeed, as can be easily understood when referring to FIGS. 9-24, in addition to protection of the thumb, the finger protecting device 1 according to these preferred embodiments of the invention additionally incorporates protection of the index and/or middle finger, or any other given finger of the hand, as apparent to a person skilled in the art. The protection can extend to varying degrees, from the base of the digits (at the first knuckle) to the second knuckle, as better shown in FIGS. 9-12, 15, and 16, or third knuckle, as better shown in FIGS. 13, 14, and 17-20.

According to the present invention, the varying degrees of finger protection can be mixed and matched, i.e. the index finger remains uncovered and the middle finger can be covered up to the second knuckle, or, for example, the index finger can be covered up to the second knuckle and the middle finger can be covered to the third knuckle, or any combination thereof, as shown in the accompanying drawings.

As previously discussed, the present finger protecting device 1 can be made particularly for a left or right hand, and comprises suitable fastening means 25, as previously discussed.

It is also worth mentioning that, according to the present invention, if required and/or advantageous for the particular applications of the finger protecting device 1, the diametrically opposite sides of a given finger need not be covered in the same way by the finger protecting device 1. Indeed, for example, the top and bottom portions of an index finger located between the second knuckle and the nail thereof may be covered by the finger protecting device 1, whereas for the portion of the index finger located between the first and second knuckles, only one of said top or bottom sides may be covered by the finger protecting device 1, as can be easily understood. In short, according to the present invention, the front and rear surfaces 7,9,107,109 of a given sleeve 5, 105, may be substantially different in shape, size and positioning with respect to a given finger.

Moreover, as aforementioned, each sleeve 5,105 of the finger protecting device 1 may be provided by various suitable orifices 32 for allowing breathing of the finger(s), and a better heat exchange between each finger and the ambient air for allowing breathability of the finger(s) during the carrying out of the sporting activities, as well as a better flexibility of the finger protecting device 1.

Preferably also, the additional sleeves 105 used for protecting the fingers other than the thumb may be provided with suitable tabs 117 securely affixed to each sleeve 105 for pulling thereon so as to facilitate the removal of the device 1 when mounted onto the other fingers. Preferably, as better shown in FIGS. 21-24, each tab 117 is securely affixed to the first end 111 of the corresponding additional sleeve 105, on the rear surface 109 thereof. When one requires to remove the device 1 from the hand, the user may simply pull on the tabs 117 so as to facilitate the removal of the sleeves 105 from their corresponding fingers. It is worth mentioning that the tabs 7, 117 could be made integral (i.e. same material and same piece) to their corresponding rear surfaces 9, 109 of sleeves 5, 105.

Figure 3:
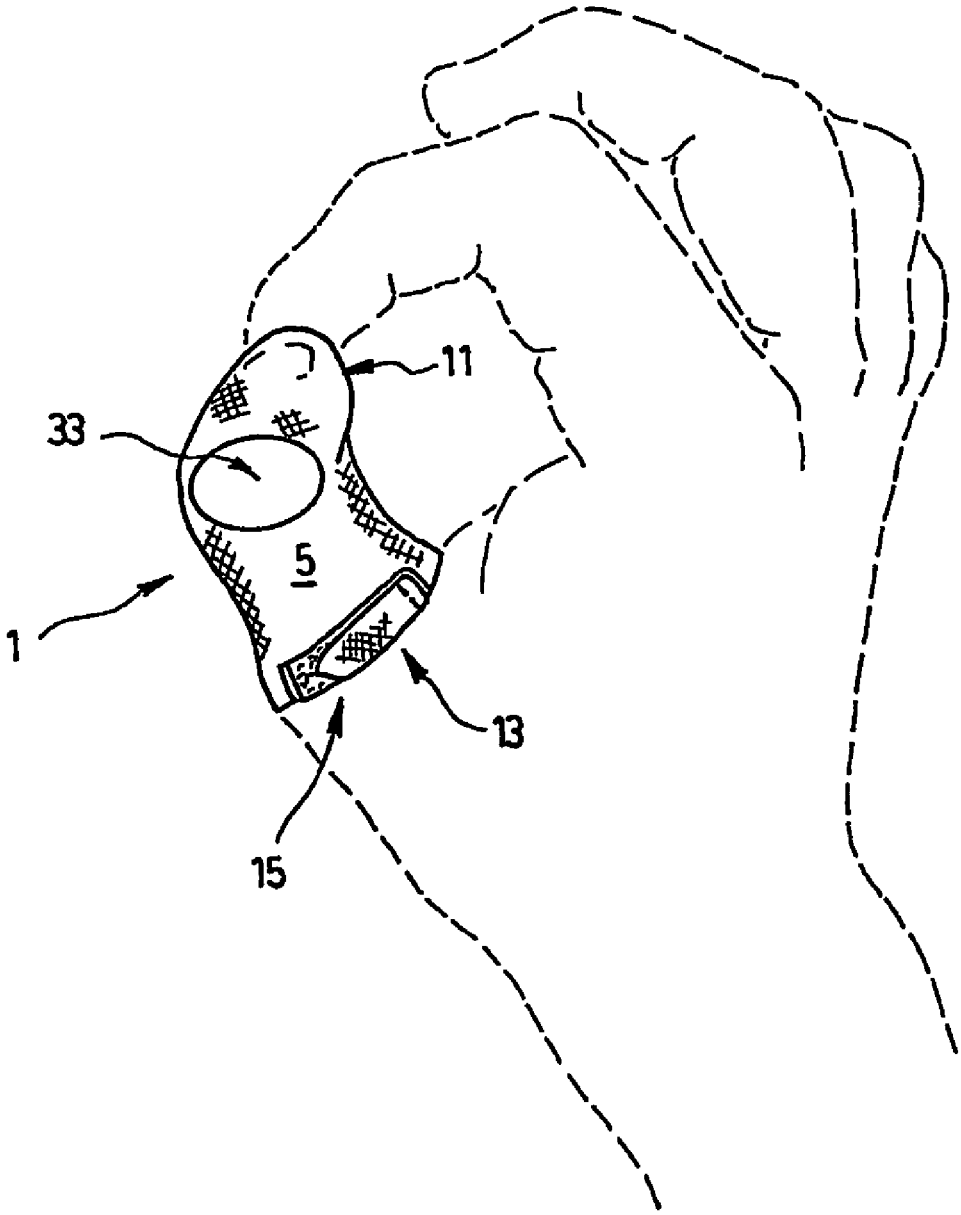
FIG. 3 is a partial perspective view of a hand provided with a finger protecting device according to yet another preferred embodiment of the invention.
Figure 4:
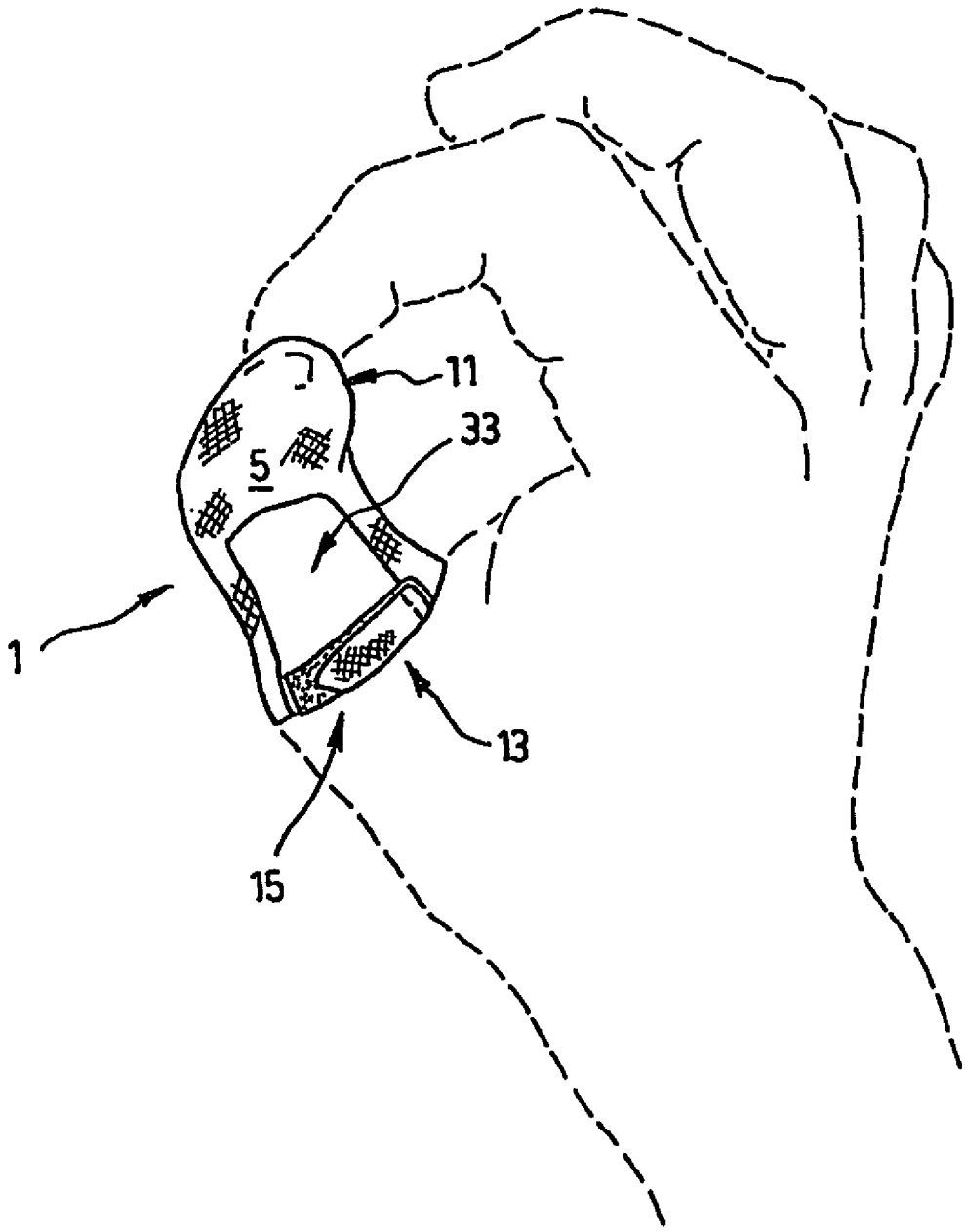
FIG. 4 is a partial perspective view of a hand provided with a finger protecting device according to yet another preferred embodiment of the invention.
Figure 5:
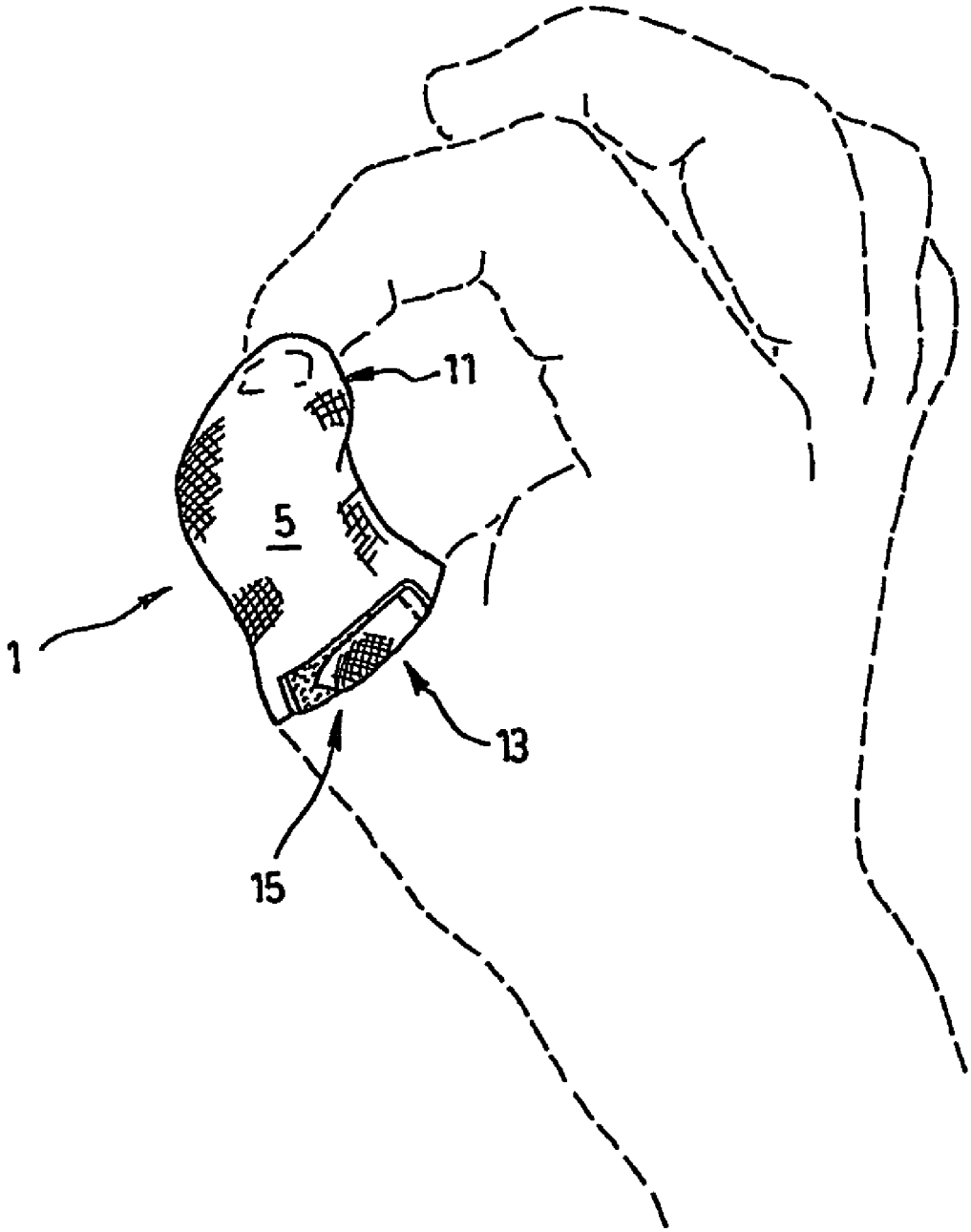
FIG. 5 is another perspective view of a hand provided with a finger protecting device according to yet another preferred embodiment of the invention.

It is worth mentioning also that the different sleeves 5,105 of the finger protecting device 1 may comprise a hole 33 on the rear surface of the sleeves for facilitating bending of the corresponding fingers when the sleeves are mounted onto said fingers, as can be easily understood, and as exemplified in FIGS. 3 and 4 for sleeve 5.

Preferably also, as better shown in FIGS. 1 and 2, sleeve 5 is provided with a padding 35 which is preferably located on the fingerprint area of the finger (in this case, a thumb) and on appropriate sides of the finger(s), which are typically most susceptible to chafing. It is worth mentioning that padding 35 may be provided on other suitable locations of the sleeves 5,105, depending on the applications for which the present finger protecting device is intended for, as apparent to a person skilled in the art. For example, for golfing applications, as exemplified in FIGS. 1, 2, 23 and 24, it is preferable that the front surface 7,107 of each sleeve 5,105 be provided with padding 35, because it is these surfaces that operatively rub against the shaft 3. However, it is worth mentioning that for other sporting activities, such as football for example, it would be preferable to have the rear surface 9,109 of each sleeve 5,105 provided also with some padding, because it is these rear surfaces of the sleeve 5,105 that are typically subjected to impact, and the padding would therefore protect these portions of the fingers from contacts with helmets, and the like.

The padding 35 is preferably made of a suitable elastometer material, such as rubber for example, foam, sponge, gel, and/or any other suitable material for providing proper cushioning between each finger and the shaft 3, such as a textile material, leather, or any other suitable material, as apparent to a person skilled in the art.

As can be easily understood, several modifications could be made to the thumb protecting device 1 according to the present invention without departing from the scope of the present invention. For example, the finger protecting device 1 may be provided with different visual signs, whether letters, colors, logos, and the like, for displaying proper visual information, such as a name brand of the finger protecting device, the size of the finger protecting device, which may be of different sizes, such as small, medium, large, and extra-large for example.

According to another aspect of the present invention, there is also provided a method of protecting at least one finger of a hand of a user of the device 1 against the occurrence of chafing resulting from rubbing of said at least one finger against a shaft 3 when practicing a sport with the shaft 3. The method comprises the steps of a) providing a device 1 such as the one briefly described herein and exemplified in the accompanying drawings; b) inserting the thumb of the hand into the sleeve via the second end 13 thereof; and c) selectively adjusting and fastening the device 1 onto the thumb and corresponding parts of the hand. Preferably also, step b) further comprises the step of inserting at least one other finger into at least one other sleeve 105 via a second end 113 thereof.

As may now be appreciated, the present invention is a substantial improvement over the prior art in that by virtue of its design and components, the finger protecting device 1 according to the present invention enables to prevent chafing and blistering of finger(s) rubbing against a golf club for example, without requiring the use of an entire glove on said hand. More particularly, as may now be better appreciated from the above-discussed, the device 1 according to the present invention is advantageous that it enables to protect at least one finger of a hand of a user of the device against the occurrence of chafing resulting from rubbing of the at least one finger against the shaft when practicing a sport with the shaft, while at the same time enabling other fingers of the hand to have their fingertips unexposed so as to have a proper "feel" of the shaft when holding the shaft. Moreover, the present device 1 is also advantageous in that its fastening means 25 with corresponding abutment flange 31 are more easily operable with a gloved hand for example, and which are also devised to maintain the finger protecting device in a given configuration, i.e. prevent the strap 29 from detaching itself from the buckle 27.

Of course, numerous other modifications could be made to the above-described embodiments without departing from the scope of the invention as defined in the appended claims.

The invention claimed is:

1. A finger protecting device for use on a hand of a golfer, the golfer's hand having a wrist, a thumb, at least two other fingers and a palm located on a front side of the golfer's hand, each of the at least two other fingers including a proximal finger portion extending between a first knuckle and a second knuckle of the corresponding finger, the device comprising:

a wristband portion shaped and sized to fit around the wrist of the golfer's hand;

at least one open-ended finger sleeve shaped and sized to cover only the proximal finger portion of a corresponding one of the at least two other fingers of the golfer's hand, the at least one open-ended finger sleeve having opposite front and rear surfaces, the front surface of the at least one open-ended finger sleeve including a front edge disposed at a junction between the palm and a base of the corresponding finger when the device is on the golfer's hand;

a closed-ended thumb sleeve shaped and sized to cover the thumb of the golfer's hand, the closed-ended thumb sleeve having opposite front and rear surfaces; and an extension portion connecting together the wristband portion, the closed-ended thumb sleeve and the at least one open-ended finger sleeve, the extension portion including a front section having a front edge disposed at a junction between the palm and a base of the thumb and extending from the base of the thumb to said wristband portion when the device is on the golfer's hand;

whereby the wristband portion, the at least one open-ended finger sleeve, the closed-ended thumb sleeve and the extension portion are configured and disposed to leave the palm of the golfer's hand entirely exposed for a direct contact with a golf club while protecting the thumb and at least one of the proximal finger portions of the golfer's hand against chafing.

2. The finger protecting device according to claim 1, wherein the device comprises only one open-ended finger sleeve.

3. The finger protecting device according to claim 2, wherein the finger of the golfer's hand covered by the single open-ended finger sleeve is an index finger.

4. The finger protecting device according to claim 1, wherein the device comprises only two open-ended finger sleeves.

5. The finger protecting device according to claim 4, wherein the fingers of the golfer's hand covered by the only two open-ended finger sleeves are an index finger and a middle finger.

6. The finger protecting device according to claim 1, wherein at least a portion of the front surface of at least one of the sleeves is padded with an additional layer of material.

7. The finger protecting device according to claim 1, wherein at least one of the sleeves is made of a stretchable material.

8. The finger protecting device according to claim 1, wherein at least one of the sleeves is made of a breathable material.

9. The finger protecting device according to claim 1, wherein the wristband portion comprises means for selectively adjusting and fastening the wristband portion onto the wrist of the golfer's hand.

10. The finger protecting device according to claim 1, wherein the wristband portion is operable between opened and closed configurations, the wristband portion comprising first and second end members removably connectable to one another.

11. The finger protecting device according to claim 1, wherein the device comprises a pulling tab securely affixed to the rear surface of the at least one open-ended finger sleeve.

* * * * *